US012601508B2

(12) United States Patent
Zhang et al.

(10) Patent No.: US 12,601,508 B2
(45) Date of Patent: Apr. 14, 2026

(54) AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Zijian Zhang, Foshan (CN); Yi Ding, Foshan (CN); Zhonghua He, Foshan (CN); Zheng Xu, Foshan (CN)

(73) Assignees: GD MIDEA AIR-CONDITIONING EQUIPMENT CO., LTD., Foshan (CN); MIDEA GROUP CO., LTD, Foshan (CN)

( * ) Notice: Subject to any disclaimer, the term of this patent is extended or adjusted under 35 U.S.C. 154(b) by 360 days.

(21) Appl. No.: 18/276,219

(22) PCT Filed: Apr. 30, 2021

(86) PCT No.: PCT/CN2021/091622
§ 371 (c)(1),
(2) Date: Aug. 7, 2023

(87) PCT Pub. No.: WO2022/166010
PCT Pub. Date: Aug. 11, 2022

(65) Prior Publication Data

US 2024/0125486 A1 Apr. 18, 2024

(30) Foreign Application Priority Data

Feb. 8, 2021 (CN) ..... 202110183865.6
Feb. 8, 2021 (CN) ..... 202120355898.X

(51) Int. Cl.
*F24F 1/0011* (2019.01)
*F24F 1/0057* (2019.01)
*F24F 13/20* (2006.01)

(52) U.S. Cl.
CPC ..... *F24F 1/0011* (2013.01); *F24F 1/0057* (2019.02); *F24F 13/20* (2013.01)

(58) Field of Classification Search
CPC ..... F24F 1/0057; F24F 13/20
(Continued)

(56) References Cited

U.S. PATENT DOCUMENTS

2020/0386423 A1* 12/2020 Chu ..... F24F 8/80
2021/0025599 A1 1/2021 Choi et al.
2021/0088236 A1* 3/2021 Lee ..... F24F 6/02

FOREIGN PATENT DOCUMENTS

CN 2839867 Y * 11/2006 ..... F24F 1/00
CN 103017313 B 1/2015
(Continued)

OTHER PUBLICATIONS

Zhong, Zhiyao, CN110594864 Translation.pdf, "Floor type air conditioner indoor unit and air conditioner", Dec. 2019, pp. 1-37.*
(Continued)

*Primary Examiner* — Avinash A Savani
*Assistant Examiner* — Ryan L Faulkner
(74) *Attorney, Agent, or Firm* — Anova Law Group, PLLC

(57) ABSTRACT

An air conditioner includes a housing having an air outlet chamber, an air treatment apparatus disposed in the housing, and an air guide mechanism movably disposed in the housing. A vent connecting the air outlet chamber with outside is formed at a sidewall of the air outlet chamber. The air treatment apparatus includes an air treatment unit and has an air inlet. The air guide mechanism is configured to connect an inner cavity of the air treatment unit with outside or isolate the inner cavity of the air treatment unit from outside. When the inner cavity of the air treatment unit is in communication with outside, air entering through the air
(Continued)

inlet flows through the air treatment unit and into the air outlet chamber, and then flows out through the vent.

20 Claims, 13 Drawing Sheets

(58) Field of Classification Search
USPC ..... 454/233
See application file for complete search history.

(56) References Cited

FOREIGN PATENT DOCUMENTS

| | | | | | |
|---|---|---|---|---|---|
| CN | 105115068 | A | | 12/2015 | |
| CN | 105135525 | A | | 12/2015 | |
| CN | 105485774 | A | | 4/2016 | |
| CN | 105526657 | A | | 4/2016 | |
| CN | 107366970 | A | | 11/2017 | |
| CN | 107676870 | A | | 2/2018 | |
| CN | 110594864 | A | * | 12/2019 | ..... F24F 13/20 |
| CN | 110732230 | A | | 1/2020 | |
| CN | 111895509 | A | | 11/2020 | |
| CN | 212179011 | U | | 12/2020 | |
| CN | 214501453 | U | | 10/2021 | |
| EP | 1686325 | A1 | * | 8/2006 | ..... F24F 1/0063 |
| JP | 2018179366 | A | | 11/2018 | |
| KR | 20020036110 | A | | 5/2002 | |
| KR | 20200106428 | A | | 9/2020 | |
| WO | 2019033700 | A1 | | 2/2019 | |
| WO | 2019177414 | A1 | | 9/2019 | |
| WO | 2020093570 | A1 | | 5/2020 | |

OTHER PUBLICATIONS

Bai, Zhongjie, CN2839867 Translation.pdf, "Indoor machine of air conditioner", Nov. 2006, pp. 1-25.*

World Intellectual Property Organization (WIPO) International Search Report and Written opinion for PCT/CN2021/091622 Oct. 11, 2021 7 Pages (Translation Included).

China National Intellectual Property Administration (CNIPA) Office Action 1 for Application No. 202110183865.6 Dec. 16, 2024 21 Pages (including translation).

State Intellectual Property Office of China Notice of Grant of Invention Patent Right for Application No. 202110183865.6 Apr. 25, 2025 3 pages (including translation).

The European Patent Office (EPO) Extended Search Report for EP Application No. 21924018.1 Jul. 2, 2024 10 Pages.

* cited by examiner

AIR CONDITIONER

CROSS-REFERENCE TO RELATED APPLICATIONS

The present application is a National Stage Entry under 35 U.S.C. § 371 of International Application No. PCT/CN2021/091622, filed on Apr. 30, 2021, which is filed based on and claims a priority to Chinese Patent Application No. 202120355898.X and No. 202110183865.6 filed on Feb. 8, 2021, the entire contents of all of which are incorporated herein by reference.

TECHNICAL FIELD

The present disclosure relates to the field of air treatment equipment technologies, and more particularly, to an air conditioner.

BACKGROUND

With consumption upgrade and pursuit of high quality of life, the air treatment apparatus in related technologies, such as air treatment apparatus with fresh air function, can hardly meet higher demand of users.

SUMMARY

The present disclosure aims to solve at least one of the technical problems in the related art. To this end, one embodiment of the present disclosure is to provide an air conditioner which can easily achieve a control of improving the indoor air quality through the movement of an air guide mechanism, thereby meeting a higher demand of users.

The air conditioner according to the embodiments of the present disclosure includes: a housing having an air outlet chamber, the air outlet chamber has a first vent formed at a sidewall of the air outlet chamber, the first vent connects the air outlet chamber with outside; an air treatment apparatus disposed in the housing, the air treatment apparatus includes an air treatment unit and has at least one air inlet; and an air guide mechanism movably disposed in the housing and configured to connect an inner cavity of the air treatment unit with outside or isolate the inner cavity of the air treatment unit from outside. When the inner cavity of the air treatment unit is in communication with outside, air flows into the air treatment unit from the at least one air inlet, then flows into the air outlet chamber, and then flows out through the first vent.

The air conditioner according to the embodiments of the present disclosure can improve the indoor air quality through the arrangement of the air treatment apparatus. The air guide mechanism is movably disposed in the housing, which achieves that the air treatment unit is connected to the outside or the air treatment unit is isolated from the outside through the movement of the air guide mechanism. Therefore, the movement of the air guide mechanism can be controlled and the control of the improved indoor air quality can be easily achieved, thereby meeting the higher demand of users.

According to some embodiments of the present disclosure, in a height direction of the housing, the air outlet chamber is disposed at a middle of the housing or is adjacent to the middle of the housing.

According to some embodiments of the present disclosure, the housing includes: a rear casing component; and a front panel connected to a front side of the rear casing component. The front panel includes an upper panel and a lower panel that are spaced apart from top to bottom, and the first vent is formed between the upper panel and the lower panel.

In some embodiments of the present disclosure, the housing includes an air outlet frame component disposed on the front side of the rear casing component. The front panel is disposed on a front side of the air outlet frame component, a part of the air outlet frame component corresponding to the air treatment unit is opened to form a removal opening, and the lower panel is configured to cover or expose the removal opening.

According to some embodiments of the present disclosure, the air guide mechanism is movably disposed in the air treatment apparatus.

According to some embodiments of the present disclosure, the air treatment apparatus includes an air outlet casing disposed in the air treatment unit. The air outlet casing forms an air outlet cavity in communication with the inner cavity of the air treatment unit, the air outlet casing has a first air outlet in communication with the air outlet cavity. The air guide mechanism is movably disposed in the air outlet casing and configured to cover or expose the first air outlet, and the first vent is in communication with the first air outlet through the air outlet chamber when the air guide mechanism exposes the first air outlet.

In some embodiments of the present disclosure, the air outlet casing is disposed below the air outlet chamber, the first air outlet is formed at a top of the air outlet casing, and the air guide mechanism is disposed in the air outlet casing in an up-down movable manner.

In one embodiment, at least a part of the air guide mechanism is disposed in the air outlet chamber when the air guide mechanism exposes the first air outlet.

In some further embodiments of the present disclosure, the air treatment apparatus includes an air induction hood disposed on the top of the air outlet casing and in the air outlet chamber. An air induction cavity is formed between the top of the air outlet casing and the air induction hood, at least a part of an air induction outlet of the air induction cavity corresponds to and is in communication with the first vent, and the first vent is in communication with the first air outlet through the air induction cavity when the air guide mechanism exposes the first air outlet.

In one embodiment, at least a part of the air guide mechanism is disposed in the air induction cavity when the air guide mechanism exposes the first air outlet.

In some embodiments of the present disclosure, the air outlet casing includes a casing body and an air outlet component, a mounting opening is formed at a top of the casing body. The air outlet component is disposed at the mounting opening, the first air outlet is formed at the air outlet component, and the air guide mechanism includes an air guide component and a mounting base. The air guide component is configured to cover or expose the first air outlet, the mounting base is connected to a lower part of the air guide component, and the mounting base penetrates through the air outlet component in an up-down movable manner.

In some exemplary embodiments of the present disclosure, the air outlet component includes: an air outlet member disposed in the mounting opening, the first air outlet is formed at the air outlet member; and a mounting member connected to a lower part of the air outlet member and disposed within the air outlet cavity. A receiving cavity having an open top is formed in the mounting member, and the mounting base is disposed in the receiving cavity in an up-down movable manner.

In one embodiment, the air outlet member includes an air outlet grille disposed at the first air outlet and includes at least one air outlet sub-grille obliquely arranged. The at least one air outlet sub-grille obliquely arranged extending upwardly and obliquely in a direction from a connection between the air outlet member and the mounting member to an outer edge of the air outlet member.

In one embodiment, the air outlet member includes an air outlet grille disposed at the first air outlet, air dispersion holes of the air outlet grille having an equivalent diameter of 3 mm to 8 mm.

In some embodiments of the present disclosure, at least one second air outlet is formed at a circumferential side wall of the air outlet casing. The housing has a second vent corresponding to and in communication with the at least one second air outlet.

In one embodiment, an air guide plate is disposed at the second vent and is configured to cover or expose the second vent.

In some embodiments of the present disclosure, the air treatment unit includes: a first fan component configured to drive air into the air treatment apparatus from the at least one air inlet; a humidification component disposed in the air outlet casing, the air outlet cavity is formed between the humidification component and the air outlet casing; and a purification component disposed between the air outlet casing and the first fan component. The purification component has a purification cavity in communication with the air outlet cavity.

In one embodiment, the first fan component, the purification component and the air outlet casing are sequentially arranged from bottom to top.

In some exemplary embodiments of the present disclosure, the humidification component includes: a humidification bracket having a humidification sink, the humidification bracket is disposed in the air outlet casing in a drawable manner; a wet film bracket disposed on the humidification bracket; a humidification film disposed in the wet film bracket, a part of the humidification film is disposed in the humidification sink; and a humidification water tank disposed in the humidification bracket. The humidification water tank is disposed on a side of the wet film bracket facing away from the air outlet cavity, and the humidification water tank is configured to supply water to the humidification sink.

Further, the air outlet casing is disposed below the air outlet chamber, the first air outlet is formed at a top of the air outlet casing, and the air guide mechanism is disposed in the air outlet casing in an up-down movable manner. At least one second air outlet is formed at a circumferential side wall of the air outlet casing, a second vent corresponding to and in communication with the second air outlet is formed at the housing, and the humidification film is close to the second air outlet and corresponding to the second air outlet.

In some exemplary embodiments of the present disclosure, the purification component includes purification members stacked in multiple layers along a direction of air flow, and the purification member in each layer is disposed in the purification cavity in a drawable manner.

According to some embodiments of the present disclosure, the at least one air inlet includes a plurality of air inlets, at least one air inlet is adapted to be in communication with outdoor air, and a remaining air inlet of the plurality of air inlets is adapted to be in communication with indoor air.

Additional aspects and advantages of the present disclosure will be given at least in part in the following description, or become apparent at least in part from the following description, or can be learned from practicing of the present disclosure.

BRIEF DESCRIPTION OF THE DRAWINGS

The aforementioned and/or additional aspects and advantages of the present disclosure will become apparent and easily understandable from the following description of embodiments combined with the accompanying drawings, wherein.

Figure 1:
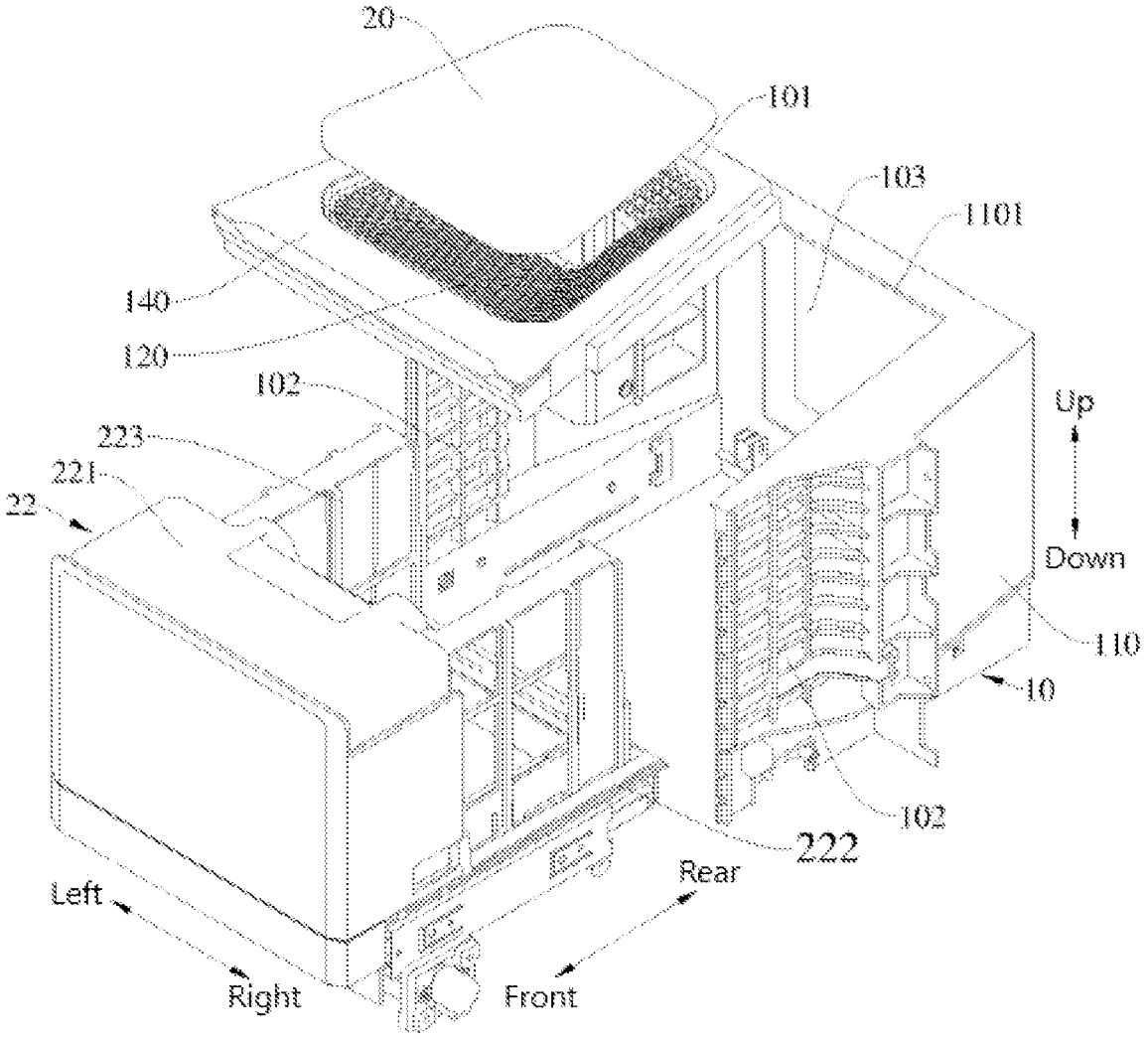
FIG. 1 is an exploded schematic view of a part of a structure of an air treatment apparatus according to an embodiment of the present disclosure.

The reference signs are explained as follows:

1000, air conditioner indoor unit;

10, air outlet casing;

101, first air outlet; 102, second air outlet; 103, air outlet cavity;

110, casing body; 1101, mounting opening; 1102, receiving groove;

120, air outlet component; 1201, air outlet member; 12011, air outlet sub-grille; 12012, air dispersal hole; 1202, mounting member; 1203, receiving cavity; 1204, first opening;

130, guide component; 1301, guide cavity; 1302, second opening

140, air guide mechanism mounting bracket;

20, air guide mechanism;

202, mounting notch;

210, air guide component; 2101, air guide ramp; 220, mounting base;

30, drive assembly;

310, drive member; 320, drive mechanism; 3201, gear; 3202, drive motor; 3203, drive box; 301, avoidance opening; 302, second mounting hole; 303, box-body locking protrusion; 304, box-body locking hole; 305, screw post; 306, mounting collar; 32031, first box body; 32032, second box body;

40, guide structure;

410, first guide member; 4101, rib; 420, second guide member; 4201, groove;

510, first limit protrusion; 520, second limit protrusion; 530, third limit protrusion;

60, mounting component;

601, alignment protrusion; 602, first mounting hole

200, air treatment apparatus;

70, air induction hood; 701, air induction cavity;

2, air treatment unit; 201, air inlet;

21, first fan component;

22, humidification component; 221, humidification water tank; 222, humidification bracket; 223, wet film bracket;

23, purification component; 231, purification member;

700, air heat exchanger apparatus;

720, second fan component;

730, heat exchanger component;

800, housing; 801, front panel; 8011 upper panel; 8012, lower panel; 802, air outlet frame component; 8021, removal opening; 803, rear casing component; 804, top cover; 805, chassis; 806, heat exchanger air inlet; 807, heat exchanger air outlet; 808, first vent; 809, second vent; 810, air guide plate; 811, air outlet chamber; 812, indoor air inlet.

DETAILED DESCRIPTION OF THE EMBODIMENTS

The embodiments of the present disclosure will be described in detail below with reference to examples thereof as illustrated in the accompanying drawings, throughout which same or similar elements are denoted by same or similar reference numerals. The embodiments described below with reference to the drawings are illustrative only, and are intended to explain, rather than limiting, the present disclosure.

An air conditioner according to the embodiments of the present disclosure is described in the following with reference to accompanying drawings.

As illustrated in FIG. 11 to FIG. 14, the air conditioner according to the embodiments of the present disclosure includes a housing 800, an air treatment apparatus 200, and an air guide mechanism 20.

The air outlet chamber 811 is formed in the housing 800, and the air outlet chamber 811 has a first vent 808 formed at a sidewall of the air outlet chamber 811. the first vent 808 connects the air outlet chamber 811 with an outside. For example, the air outlet cavity 811 has the first vent 808 formed at a front side wall of the air outlet cavity 811, and a part of the housing 800 forms the side wall of the air outlet cavity 811. When the air conditioner or an air conditioner indoor unit 1000 of the air conditioner is placed in an indoor space for operation, the outside means an indoor space.

The air treatment apparatus 200 is disposed in the housing 800. The air treatment apparatus 200 includes an air treatment unit 2, and the air treatment apparatus 200 has at least one air inlet 201. When the air treatment apparatus 200 is in operation, air flows into the air treatment unit 2 through the at least one air inlet 201, which can be humidified, purified, etc. by the air treatment unit 2. If the at least one air inlet 201 is in communication with indoor air, the indoor air flows into the indoor space after being treated by the air treatment unit 2, to improve indoor air quality. If the at least one air inlet 201 is in communication with outdoor air, the outdoor air flows into the indoor space after being treated by the air treatment unit 2. The fresh air is treated as it is introduced, to further improve the indoor air quality.

The air guide mechanism 20 is movably disposed in the housing 800 to connect an inner cavity of the air treatment unit 2 with the outside or isolate the inner cavity of the air treatment unit 2 from the outside. When the inner cavity of the air treatment unit 2 communicates with the outside, air flows into the air treatment unit 2 from the at least one air inlet 201, then flows into the air outlet chamber 811, and then flows out through the first vent 808. The air guide mechanism is movably disposed in the housing, which achieves that the air treatment unit is connected to the outside or the air treatment unit is isolated from the outside through the movement of the air guide mechanism. Therefore, the movement of the air guide mechanism can be controlled and the control of the improved indoor air quality can be easily achieved, thereby meeting the higher demand of users.

The air conditioner includes an air heat exchanger apparatus 700, and the air treatment apparatus 200 is located on one side of the air heat exchanger apparatus 700. For example, the air treatment apparatus 200 is located on an upper or lower side of the air heat exchanger apparatus 700. The air heat exchanger apparatus 700 may include a second fan component 720 and a heat exchanger component 730. The air heat exchanger apparatus 700 may exchange heat with air so as to adjust an indoor temperature.

In one embodiment, the air conditioner may be a split type air conditioner, i.e., the air conditioner may be a split wall-mounted air conditioner or a split floor-mounted air conditioner. The air conditioner may also be a one-piece air conditioner. When the air conditioner is the split air conditioner, the air conditioner includes the air conditioner indoor unit 1000 and an air conditioner outdoor unit. The air conditioner indoor unit 1000 includes the air treatment apparatus 200 and the air heat exchanger apparatus 700 as described above.

The air conditioner according to the embodiments of the present disclosure can improve the indoor air quality by the disposed air treatment apparatus 200. The air guide mechanism 20 is movably disposed in the housing 800, which achieves that the air treatment unit 2 is connected to the outside or the air treatment unit 2 is isolated from the outside through the movement of the air guide mechanism 20. Therefore, the movement of the air guide mechanism 20 can be controlled and the control of the improved indoor air quality can be easily achieved, thereby meeting the higher demand of users.

According to some embodiments of the present disclosure, with reference to FIG. 11 to FIG. 14, in a height direction of the housing 800, the air outlet chamber 811 is disposed at a middle of the housing 800 or is adjacent to the middle of the housing 800. Thus, in the height direction of the housing 800, by disposing the air outlet chamber 811 at the middle of the housing 800 or adjacent to the middle of the housing 800, the air exchanger apparatus 700 of the air conditioner can be located above the air outlet chamber 811, and the air treatment apparatus 200 of the air conditioner can be located below the air outlet chamber 811, which makes a reasonable layout of an overall structure. The first vent 808 is disposed corresponding to the air outlet cavity 811, and the first vent 808 is disposed at the middle of the housing 800 or is adjacent to the middle of the housing 800 in the height direction of the housing 800. By doing so, the air flows out from a position in the middle of the housing 800 in a general height direction after being treated by the air treatment unit 2 of the air treatment device 200.

According to some embodiments of the present disclosure, with reference to FIG. 11 to FIG. 14, the housing 800 includes a rear casing component 803 and a front panel 801. The front panel 801 is connected to a front side of the rear casing component 803. The front panel 801 includes an upper panel 8011 and a lower panel 8012 that are spaced apart from top to bottom, and the first vent 808 is formed between the upper panel 8011 and the lower panel 8012. Therefore, the formation of the first vent 808 is facilitated, and making a venting area of the first vent 808 is larger, thereby increasing a venting volume.

In some embodiments of the present disclosure, the housing 800 includes an air outlet frame component 802 disposed on the front side of the rear casing component 803, and the front panel 801 is disposed on a front side of the air outlet frame component 802. A part of the air outlet frame component 802 corresponding to the air treatment unit 2 is exposed to form a removal opening 8021, and the lower panel 8012 covers or exposes the removal opening 8021. Based on this, the purification and humidification components, and other components of the air treatment unit 2 of the air treatment apparatus 200 can be easily replaced and maintained, such as replacing a purification device, a humidification module, etc. For example, the lower panel 8012 may be detachably disposed on the front side of the air outlet frame component 802. When the lower panel 8012 is mounted on the front side of the air outlet frame component 802, the lower panel 8012 covers the removal opening 8021. When the lower panel 8012 is removed from the front side of the air outlet frame component 802, the removal opening 8021 can be exposed, so that the purification and humidification components, and other components of the air treatment unit 2 of the air treatment apparatus 200 can be easily replaced and maintained. For another example, the lower panel 8012 may be rotatable on the front side of the air outlet frame component 802. By rotating the lower panel 8012, the lower panel 8012 can cover or expose the removal opening 8021. When the lower panel 8012 is rotated to the front side of the air outlet frame component 802, the lower panel 8012 covers the removal opening 8021. When the lower panel 8012 is rotated beyond the front side of the air outlet frame component 802, the removal opening 8021 can be exposed, so that the purification and humidification components, and other components of the air treatment unit 2 of the air treatment apparatus 200 can be easily replaced and maintained.

Figure 11:
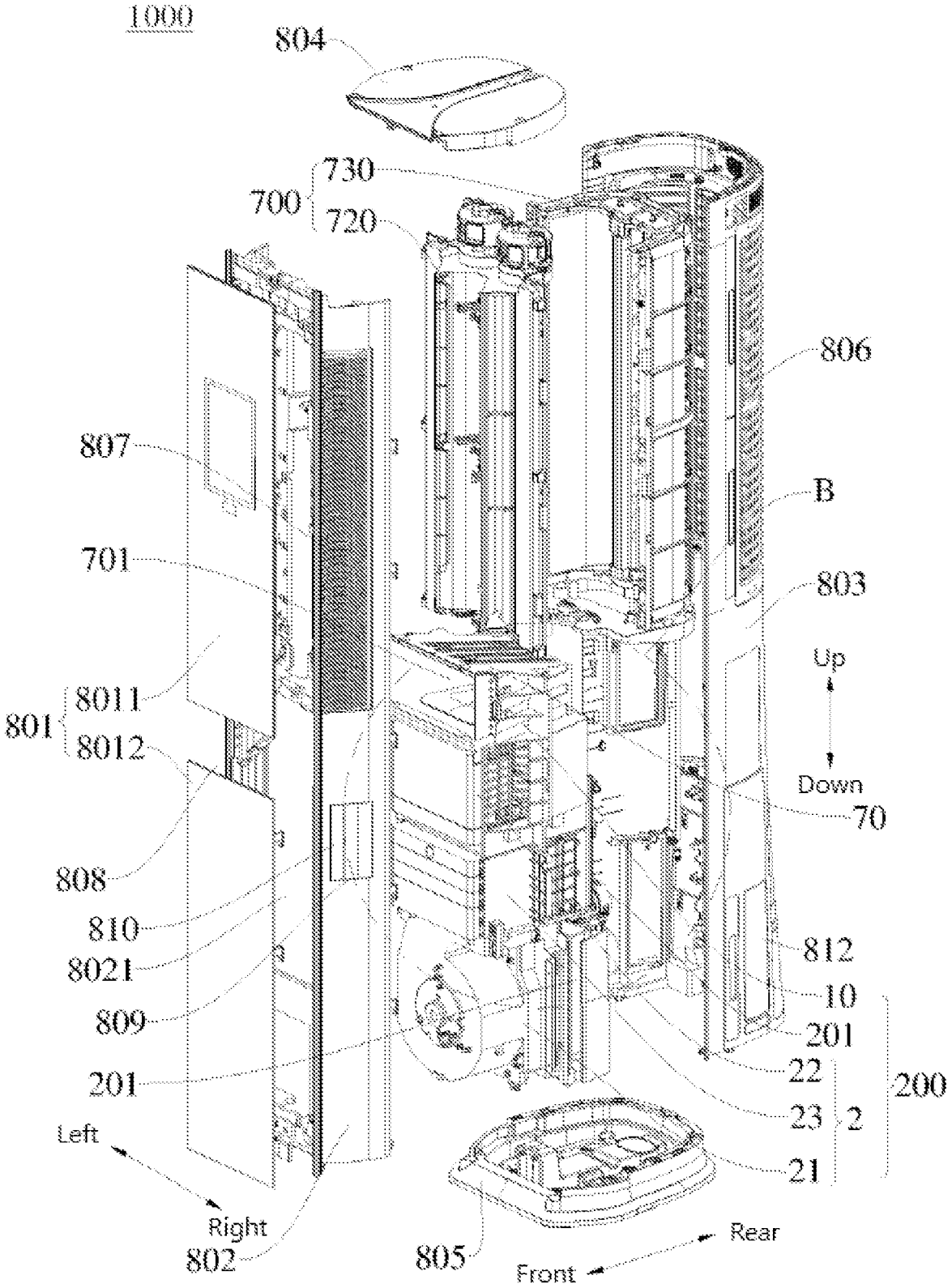
FIG. 11 is an exploded schematic view of an air conditioner indoor unit of an air conditioner according to an embodiment of the present disclosure.
Figure 12:
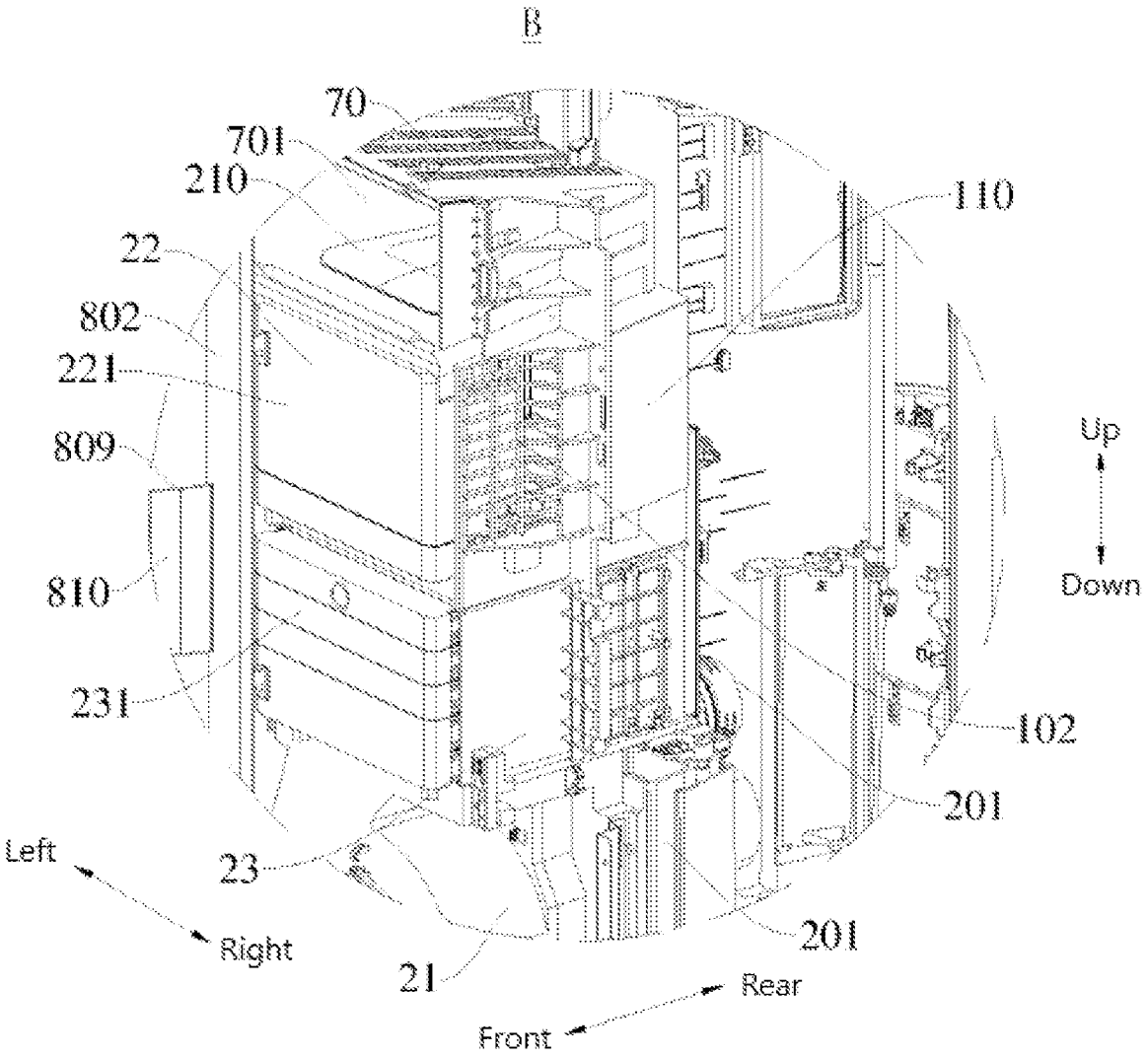
FIG. 12 is a partially enlarged schematic diagram of B in FIG. 11.

According to some embodiments of the present disclosure, with reference to FIG. 1, FIG. 11 and FIG. 12, the air guide mechanism 20 is movably disposed in the air treatment apparatus 200. Therefore, a mounting of the air guide mechanism 20 is facilitated, and the air guide mechanism 20 and the air treatment device 200 are formed as an integrated module, resulting in that the structure of whole machine is compact.

According to some embodiments of the present disclosure, with reference to FIG. 1, FIG. 8, FIG. 11 and FIG. 12, the air treatment apparatus 200 includes an air outlet casing 10. The air outlet casing 10 is disposed in the air treatment unit 2. The air outlet casing 10 has an air outlet cavity 103 in communication with the inner cavity of the air treatment unit 2. The air outlet casing 10 has a first air outlet 101 in communication with the air outlet cavity 103. The air guide mechanism 20 is movably disposed in the air outlet casing 10 to cover or expose the first air outlet 101. When the air guide mechanism 20 exposes the first air outlet 101, the first vent 808 communicates with the first air outlet 101 through the air outlet chamber 811. When the air treatment apparatus 200 is in operation, the air guide mechanism 20 exposes the first air outlet 101. Air flows into the air outlet cavity 103 of the air outlet casing 10 from the at least one air inlet 201 after being treated by the air treatment unit 2, then flows into the air outlet cavity 811 through the first air outlet 101, and then flows into the indoor space through the first vent 808. Based on the arrangements of the air outlet casing 10 and the air guide mechanism 20 movably disposed in the air outlet casing 10, the air treatment unit 2 can be easily connected with the outside and isolated from the outside through the movement of the air guide mechanism 20.

In some embodiments of the present disclosure, the air outlet casing 10 is disposed below the air outlet. The air outlet casing 10 has the first air outlet 101 formed at a top of the air outlet casing 10, and the air guide mechanism 20 is disposed in the air outlet casing 10 in an up-down movable manner. Thus, a structure layout is reasonable, and when the air treatment apparatus 200 is in operation, the air guide mechanism 20 exposes the first air outlet 101. Air flows into the air outlet cavity 103 of the air outlet casing 10 from the at least one air inlet 201 after being treated by the air treatment unit 2, then flows into the air outlet cavity 811 through the first air outlet 101, and finally flows into the indoor space through the first vent 808. Based on the arrangements of the air outlet casing 10 and the air guide mechanism 20 movably disposed in the air outlet casing 10, the air treatment unit 2 can be easily connected with the outside and isolated from the outside through the movement of the air guide mechanism 20, and the air treatment apparatus 200 can provide air from the top. An upward and downward movement of the air guide mechanism 20 facilitates covering and exposing of the first air outlet 101. When the air guide mechanism 20 moves upward to a first position, the air guide mechanism 20 exposes the first air outlet 101; when the air guide mechanism 20 moves downward to a second position, the air guide mechanism 20 covers the first air outlet 101.

The air treatment apparatus 200 also includes a drive assembly 30 configured to drive the air guide mechanism 20 to move up and down, thereby realizing automatic lifting of the air guide mechanism 20, realizing automatic exposing or covering of the first air outlet 101. When the first air outlet 101 is needed to provide air, the drive assembly 30 drives the air guide mechanism 20 to move upwards, the air guide mechanism 20 is lifted and gradually moves away from the air outlet casing 10 to expose the first air outlet 101, and the air treatment apparatus 200 can then provide air from the top. When the first air outlet 101 does not need to provide air, the drive assembly 30 drives the air guide mechanism 20 to move downward, and the air guide mechanism 20 gradually approaches the air outlet casing 10 and fits on the first air outlet 101, thus covering the first air outlet 101.

The first air outlet 101 formed at the top of the air outlet casing 10 can realize the top air outlet, providing a new type of air outlet. A way of the drive assembly 30 driving the lift of the air guide mechanism 20 can easily realize the exposing and covering of the first air outlet 101 at the top of the air outlet casing 10, thereby realizing a top air outlet effect, enhancing the user experience and further meeting user needs.

Figure 13:
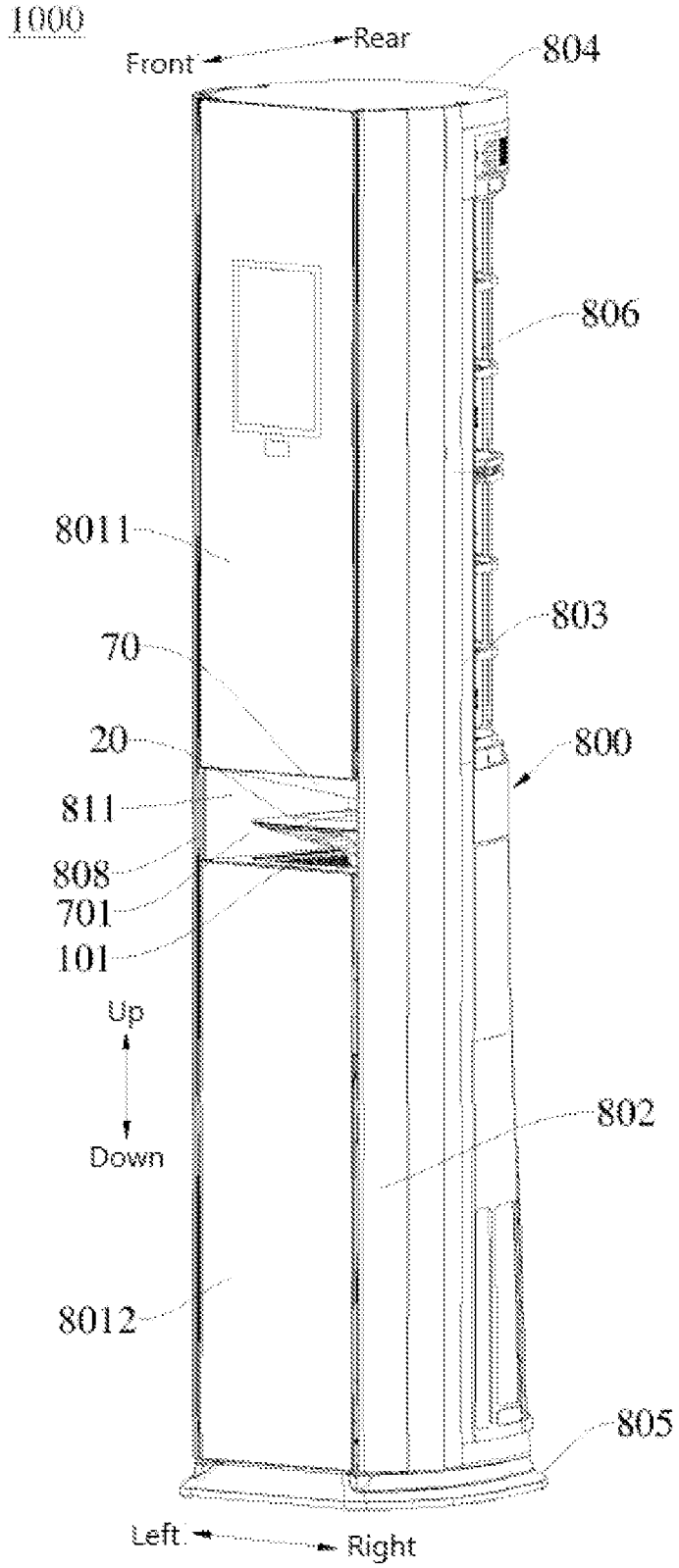
FIG. 13 is a schematic three-dimensional view of a structure of an air conditioner indoor unit of an air conditioner according to an embodiment of the present disclosure.
Figure 14:
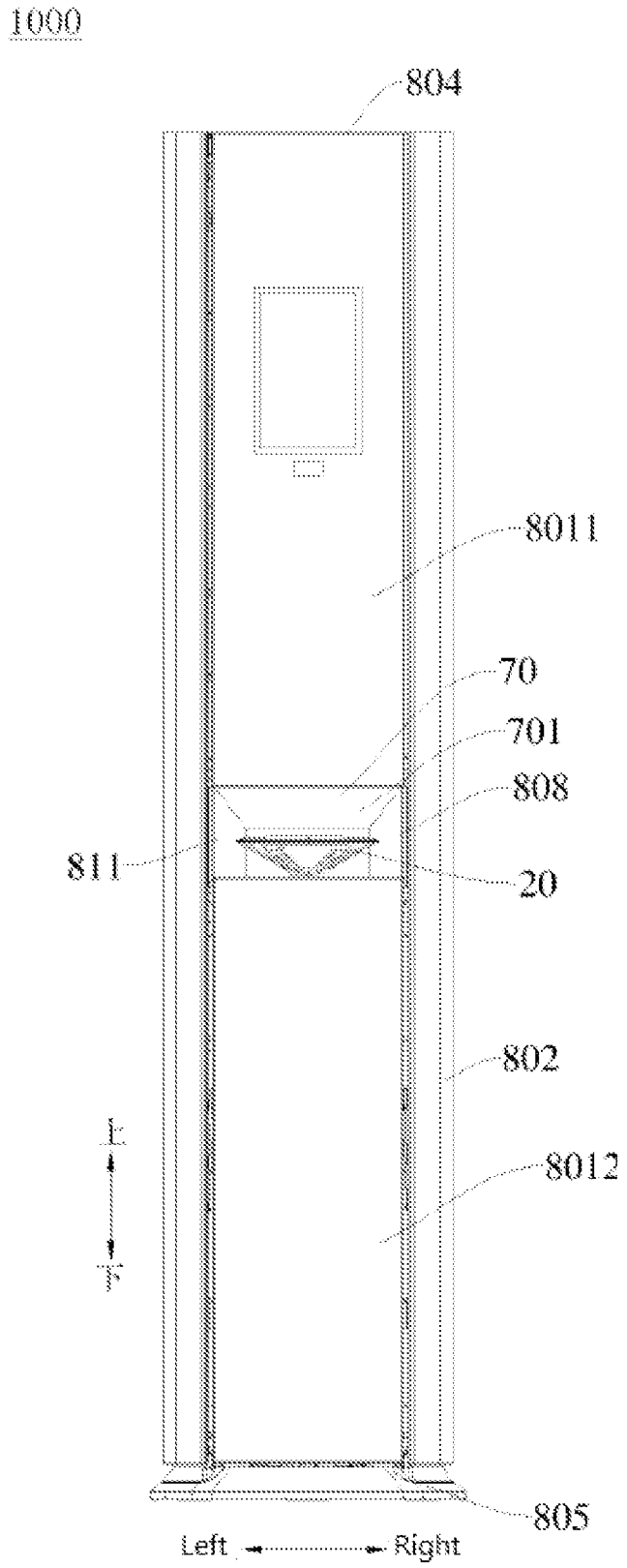
FIG. 14 is a main view of an air conditioner indoor unit of an air conditioner according to an embodiment of the present disclosure.

In some embodiments of the present disclosure, with reference to FIG. 13 and FIG. 14, at least a portion of the air guide mechanism 20 is located in the air outlet chamber 811 when the air guide mechanism 20 exposes the first air outlet 101, e.g., a part of the air guide mechanism 20 may be disposed in the air outlet cavity 811. Thus, space in the air outlet cavity 811 can be fully utilized, resulting in that the overall structure is compact.

In some embodiments of the present disclosure, with reference to FIG. 11 to FIG. 14, the air treatment apparatus 200 includes an air induction hood 70. The air induction hood 70 is disposed on the top of the air outlet casing 10 and is disposed in the air outlet chamber 811. An air induction cavity 701 is formed between the top of the air outlet casing 10 and the air induction hood 70 and is disposed in the air outlet chamber 811. At least a part of an air induction outlet of the air induction cavity 701 is correspond to and in communication with the first vent 808. The first vent 808 communicates with the first air outlet 101 through the air induction cavity 701 when the air guide mechanism 20 exposes the first air outlet 101. When the air guide mechanism 20 exposes the first air outlet 101, the air induction cavity 701 is connected to the first air outlet 101. Air flow from the first air outlet 101, subsequent to being guided by the air induction cavity 701, can flow to the indoor space through the first vent 808. The air induction hood 70 may provide a better guidance of the air and guide the air to the first vent 808 for outward air, when the air treated by the air treatment unit 2 flows into the air outlet chamber 811 through the air outlet cavity 103 and the first air outlet 101. An outer wall of the air induction hood 70 may be connected to an inner wall of the housing 800 so that a volume of the draft chamber 701 is approximately the same as the volume of the air outlet chamber 811. The outer wall of the air induction hood 70 can be spaced apart from the inner wall of the housing 800 so that the volume of the air induction cavity 701 is significantly smaller than the volume of the air outlet chamber 811.

In one embodiment, at least a portion of the air guide mechanism 20 is disposed in the air induction cavity 701 when the air guide mechanism 20 exposes the first air outlet 101. Thus, the space of the air induction cavity 701 can be fully utilized, resulting in that the overall structure is compact.

In some embodiments of the present disclosure, with reference to FIG. 1 to FIG. 3 and FIG. 8 to FIG. 9, the air outlet casing 10 includes a casing body 110 and an air outlet component 120. A mounting opening 1101 is formed at a top of the casing body 110. The air outlet component 120 is disposed at the mounting opening 1101. The first air outlet 101 is formed at the air outlet component 120. The air guide mechanism 20 includes an air guide component 210 and a mounting base 220. The air guide component 210 is configured to cover or expose the first air outlet 101. The mounting base 220 is connected to a lower part of the air guide component 210, and the mounting base 220 penetrates through the air outlet component 120 in an up-down movable manner. The mounting base 220 of the air guide mechanism 20 can penetrate through the air outlet component 120 of the air outlet casing 10 in an up-down movable manner, resulting in that the overall structure is compact. The air outlet component 120 can play a certain guide role for the up-down movement of the mounting base 220, which makes the movement of the air guide mechanism 20 more stable.

In some exemplary embodiments of the present disclosure, with reference to FIG. 1 to FIG. 3 and FIG. 6 to FIG. 9, the air outlet component 120 includes an air outlet member 1201 and a mounting member 1202. The air outlet member 1201 is disposed in the mounting opening 1101. The first air outlet 101 is formed at the air outlet member 1201. The mounting member 1202 is connected to a lower part of the air outlet member 1201 and is disposed within the air outlet cavity 103. A receiving cavity 1203 having an open top is formed in the mounting member 1202, and the mounting base 220 is disposed in the receiving cavity 1203 in an up-down movable manner. The air outlet component 120 includes the air outlet member 1201 and the mounting member 1202 which are connected in an up and down manner, which facilitates a formation of the first air outlet 101 and also facilitates a mounting and movement of the mounting base 220 of the air guide mechanism 20. Since the mounting base 220 is disposed in the receiving cavity 1203 in an up-down movable manner, the receiving cavity 1203 has a better guide effect on the mounting base 220 when the air guide 20 moves, making the movement of the air guide mechanism 20 more stable.

Further, with reference to FIG. 1 to FIG. 3 and FIG. 10, the air outlet member 1201 includes an air outlet grille disposed at the first air outlet 101. The air outlet grille includes at least one air outlet sub-grille obliquely arranged 12011, and the air outlet sub-grille 12011 obliquely arranged extends upwardly and obliquely in a direction from a connection between the air outlet member 1201 and the mounting member 1202 to an outer edge of the air outlet member 1201. The arrangement of the air outlet grille at the first air outlet 101 can play a role in dispersing air, which makes air outlet soft. The air outlet grille includes at least one air outlet sub-grille 12011 obliquely arranged that may reduce space occupied by the air outlet grille in a horizontal direction to provide a compact air outlet structure, and may better guide air from the air outlet cavity 103 toward the air outlet chamber 811.

Figure 10:
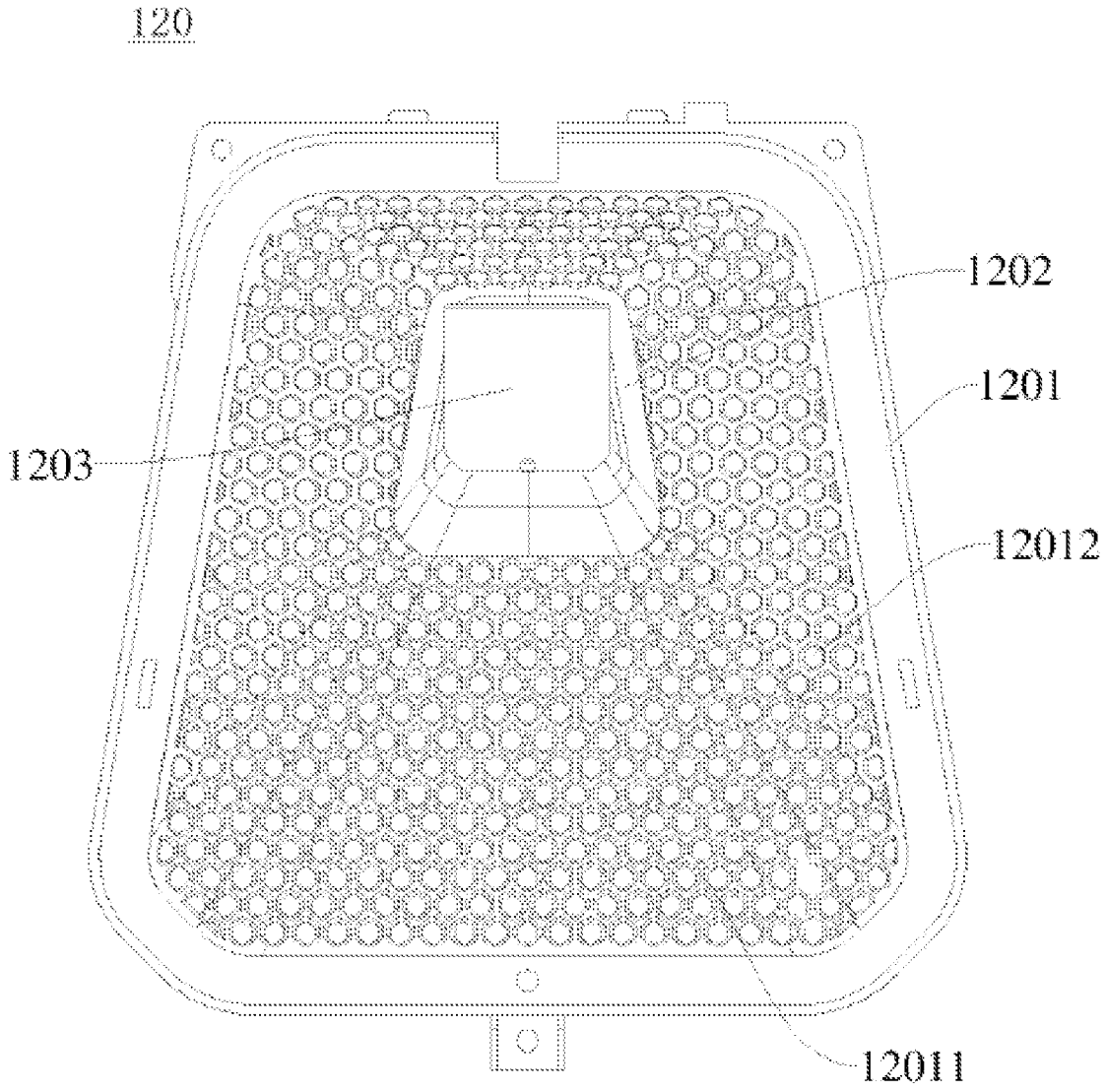
FIG. 10 is a schematic diagram of a structure of an air outlet component according to an embodiment of the present disclosure.

In one embodiment, with reference to FIG. 10, the air outlet member 1201 includes the air outlet grille disposed at the first air outlet 101, and the air dispersion holes 12012 of the air outlet grille has an equivalent diameter of 3 mm to 8 mm. The equivalent diameter of the air dispersion holes 12012 can take any of the values from 3 mm to 8 mm. The equivalent diameter of the air dispersion holes 12012 means a diameter of a circle that is equal to a cross-sectional area of the air dispersion holes 12012. For example, the equivalent diameter of the air dispersion holes 12012 can be 3 mm, 3.5 mm, 4 mm, 4.5 mm, 5 mm, 5.5 mm, 6 mm, 6.5 mm, 7 mm, 7.5 mm, or 8 mm. Thus, on the one hand, the equivalent diameter of the air dispersion holes 12012 is not too small, so as to ensure an air volume of the air dispersion holes 12012. On the other hand, the equivalent diameter of the air dispersion holes 12012 is not too large, which is conducive to ensuring a weakening effect of air of the air dispersion holes 12012, and at the same time, it prevents external debris entering or leaving the housing through the air dispersion holes 12012, which is conducive to ensuring an operational reliability of the air conditioner.

In some embodiments of the present disclosure, with reference to FIG. 1, the air outlet casing 10 includes the casing body 110 and the air outlet component 120. The casing body 110 has a mounting opening 1101 formed at a top of the casing body 110. The air outlet component 120 is disposed at the mounting opening 1101. The first air outlet 101 is formed at the air outlet component 120. Air flows into the air outlet casing 10, then flows into the casing body 110, and then flows out through the first air outlet 101 of the air outlet component 120. The drive assembly 30 includes a drive member 310 and a drive mechanism 320. The drive member 310 may be disposed on the air guide mechanism 20. The drive mechanism 320 may be disposed on the air outlet component 120. The drive mechanism 320 and the drive member 310 may be transmission cooperated, so that the drive member 310 can be driven in an up-down movable manner. By arranging the air outlet casing 10 as a structure including the casing body 110 and the air outlet component 120 and disposing the air guide mechanism 20 on the air outlet component 120, the drive mechanism 320 is easily to be mounted and fixed and the structure is compact. Moreover, the arrangement is convenient to realize a transmission cooperation between the drive mechanism 320 and the drive member 310, which can achieve that the layout is compact and the space is saved.

Figure 6:
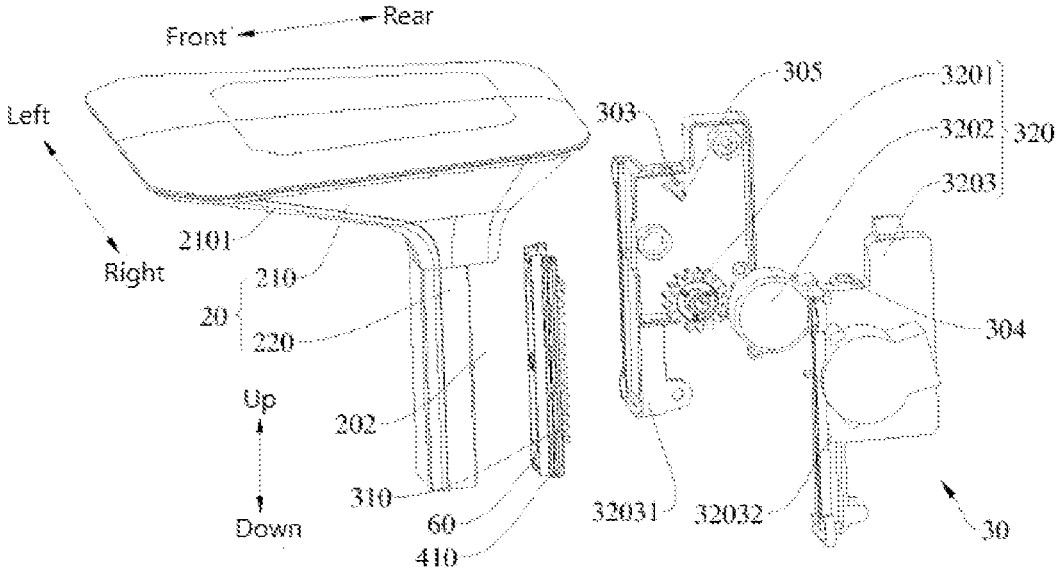
FIG. 6 is a third schematic diagram of a part of a structure of an air treatment apparatus according to an embodiment of the present disclosure.
Figure 7:
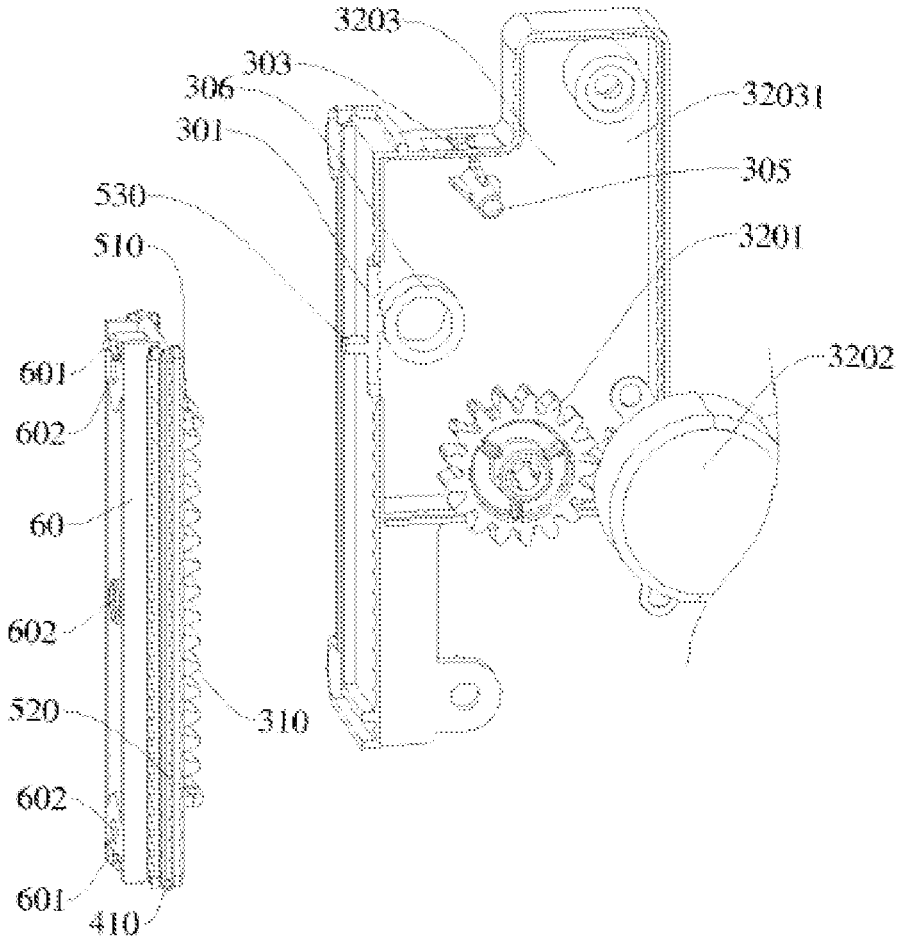
FIG. 7 is an exploded schematic view of a drive assembly according to an embodiment of the present disclosure.

In one embodiment, with reference to FIG. 6 and FIG. 7, the drive mechanism 320 includes a gear transmission mechanism and a drive motor 3202. The gear transmission mechanism includes at least one gear 3201. The drive member 310 is a rack, and the gear 3201 located at an end of the gear transmission mechanism engages with the rack. The drive motor 3202 is coupled to the gear transmission mechanism to drive a movement of the gear transmission mechanism. For example, when the drive motor 3202 drives the end gear 3201 to turn clockwise, the gear 3201 engages the rack and drives the rack to move upward, and the rack drives the air guide mechanism 20 to move upward to expose the first air outlet 101. When the drive motor 3202 drives the end gear 3201 to turn counterclockwise, the gear 3201 engages the rack and drives the rack to move downward, and the air guide mechanism 20 moves downward to cover the first air outlet 101. Using such a way that the gear and rack cooperate to drive the air guide mechanism up and down, the structure is simple, stable transmission, and more reliable.

In one embodiment of the present disclosure, as illustrated in FIG. 6 and FIG. 7, the gear transmission mechanism may include the gear 3201. When the gear transmission mechanism includes one gear 3201, the gear 3201 is located at the end of the gear transmission mechanism. The gear 3201 is connected to a motor shaft of the drive motor 3202, and the gear 3201 engages the rack. As the drive motor 3202 drives the gear 3201 to rotate, the gear 3201 engages the rack, and as the drive motor 3202 drives the gear 3201 to rotate, the drive rack moves up and down, so that the rack drives the air guide mechanism 20 to move up or down. Using a gear 3201 can simplify a drive mechanism 320 structure and reduce costs. The gear transmission mechanism may also be a plurality of gears in sequence, where a starting gear is connected to the motor shaft of the drive motor 3202, and the end gear engages the rack, which can also move the air guide mechanism 20 up and down.

Further, as illustrated in FIG. 6 and FIG. 7, the drive mechanism 320 may also include a drive box 3203. The drive box 3203 may be connected to the air outlet component 120, and both the drive motor 3202 and the gear transmission mechanism may be disposed in the drive box 3203. The drive box 3203 has an avoidance opening 301. A tooth portion of the gear 3201 disposed at the end of the gear transmission mechanism extends outside the drive box 3203 through the avoidance opening 301 and engages with the rack (i.e., the drive member 310) to facilitate cooperation between the gear 3201 disposed at the end of the gear transmission mechanism and the drive member 310 disposed outside the drive box 3203. The drive box 3203 may provide a mounting position to the gear transmission mechanism and the drive motor 3202, and also may play a protective role for the gear transmission mechanism and the drive motor 3202 to avoid dust or other contaminants from entering the gear rack engagement, thus ensuring an overall performance of the drive mechanism 320.

In some exemplary embodiments of the present disclosure, the gear transmission mechanism includes a gear 3201. Amounting collar 306 is disposed on an inner wall of the drive box 3203, and the mounting collar 306 is close to the avoidance opening 301 on the drive box 3203. One end of a gear shaft of the gear 3201 is connected to the motor shaft of the drive motor 3202 and is fixed relative to the motor shaft of the drive motor 3202. The other end of the gear shaft of the gear 3201 is accommodated in a mating hole formed by the mounting collar 306. The other end of the gear shaft of the gear 3201 is rotatable relative to the mating hole formed by the mounting collar 306. By the arrangement of the mounting collar 306, a mounting of the gear 3201 is more stable and reliable, thereby making a transmission of the gear 3201 more stable and reliable.

Figure 2:
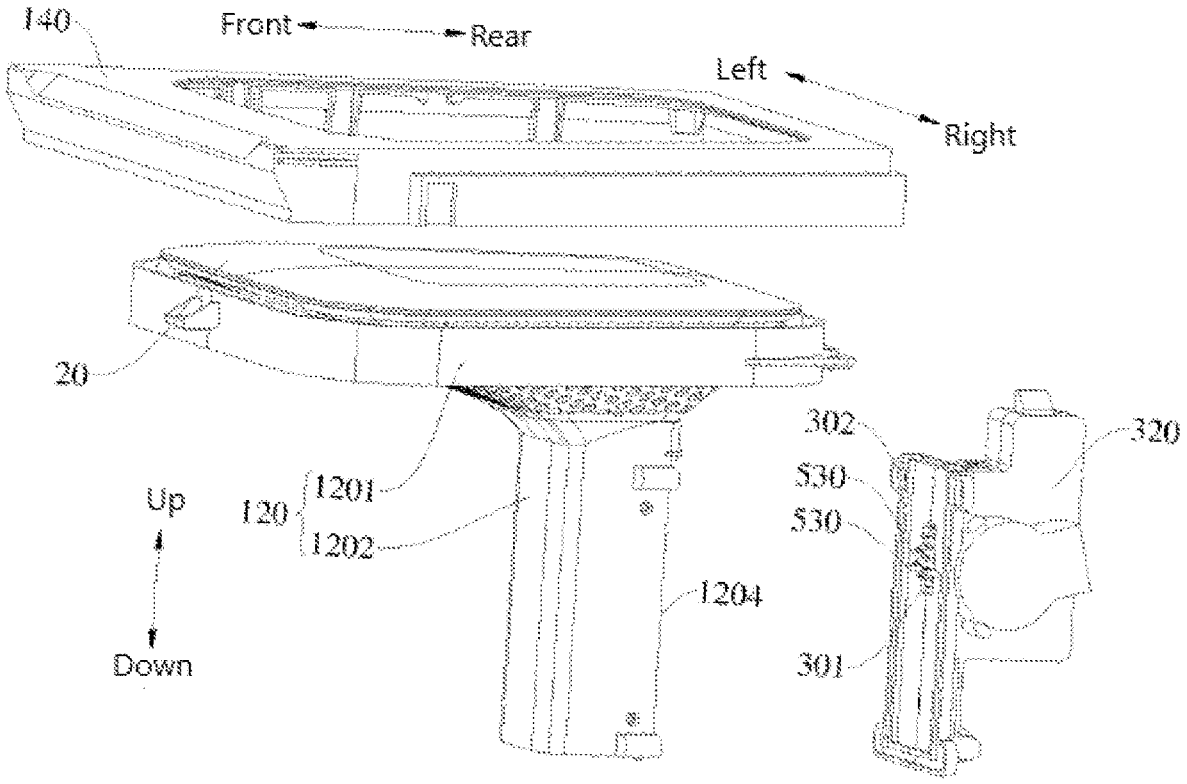
FIG. 2 is a first exploded schematic view of a part of a structure of an air treatment apparatus according to an embodiment of the present disclosure.

In some embodiments, as illustrated in FIG. 2 and FIG. 6, the drive box 3203 is detachably disposed on the air outlet component 120. The drive box 3203 may be detachably disposed on the air outlet component 120 by bolts. For example, the drive box 3203 has a second mounting hole 302, and the air outlet component 120 has a threaded hole. Fastener is penetrated through the second mounting hole 302 and fits over the threaded hole.

Figure 8:
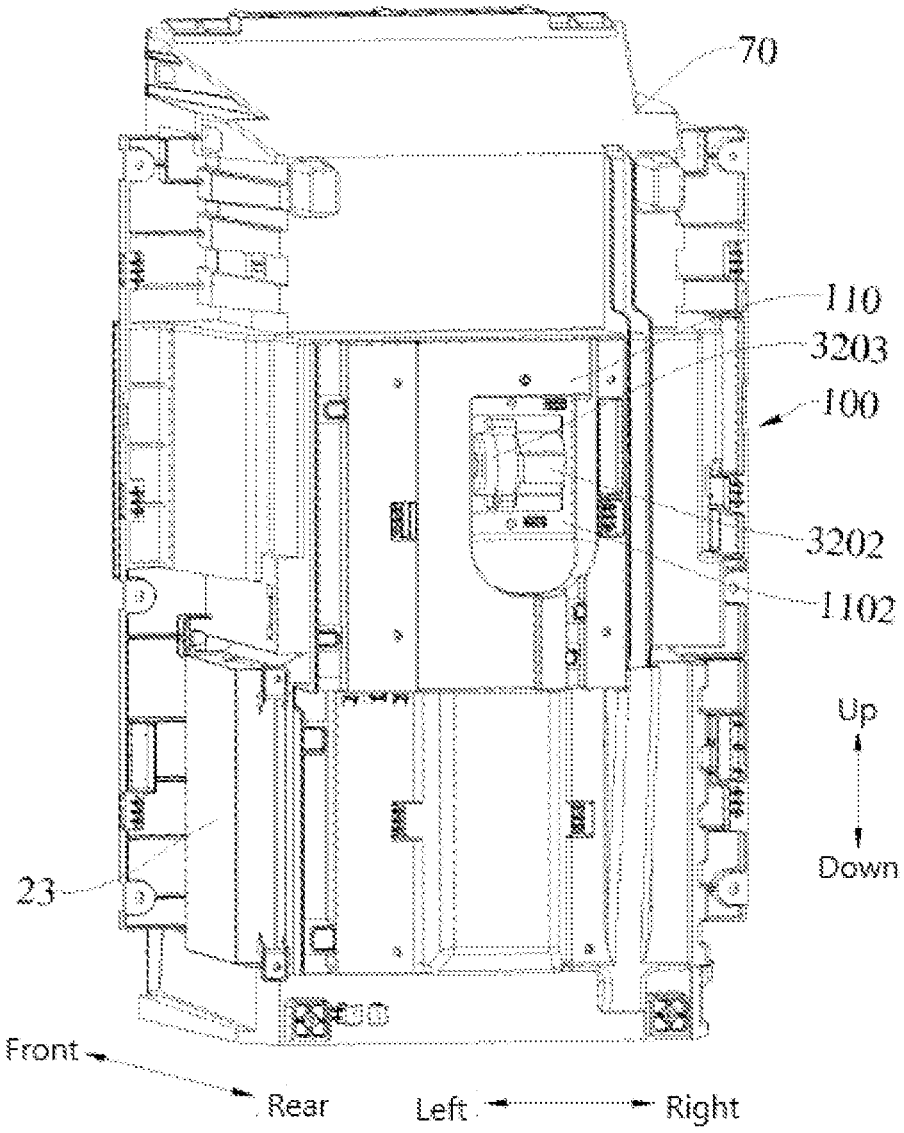
FIG. 8 is a diagram of a part of a structure of an air treatment apparatus according to an embodiment of the present disclosure.
Figure 9:
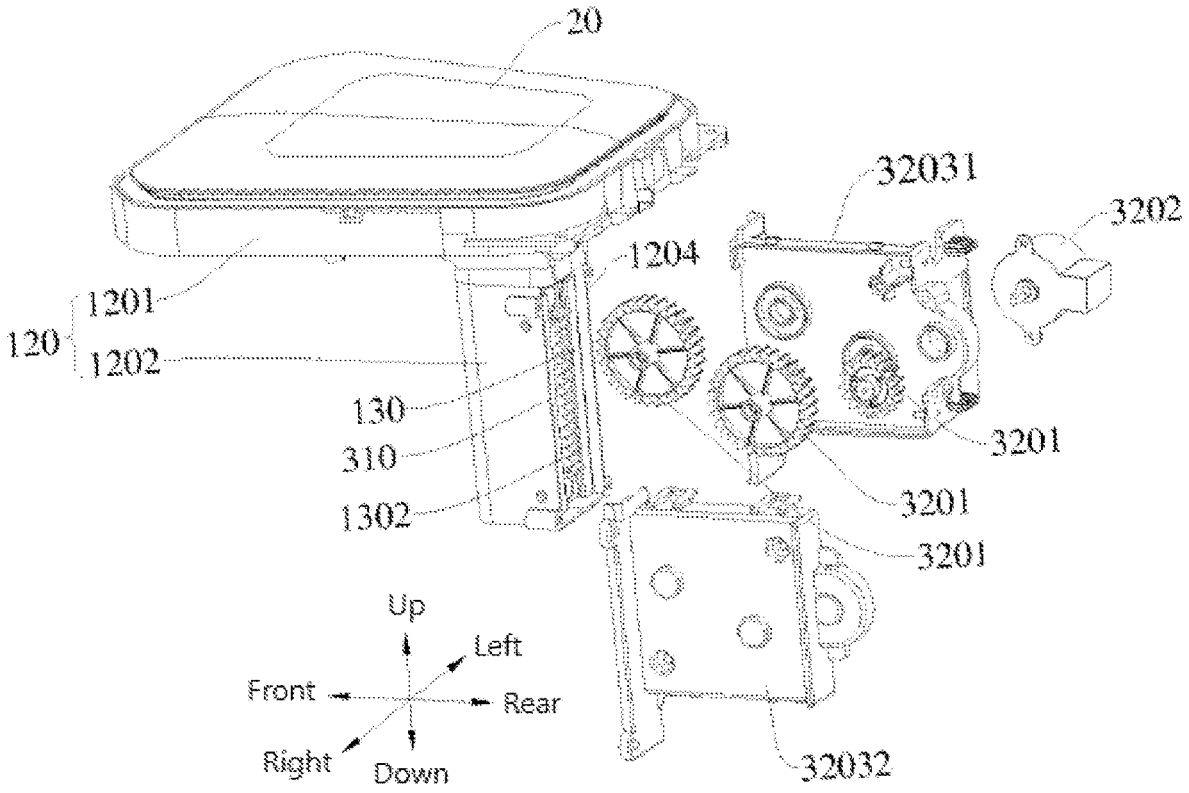
FIG. 9 is an exploded schematic view of a part of the air treatment apparatus illustrated in FIG. 8.

According to some embodiments of the present disclosure, with reference to FIG. 8 and FIG. 9, the drive assembly 30 includes the drive member 310 and the drive mechanism 320. The drive member 310 may be disposed on the air guide mechanism 20. The drive mechanism 320 may be disposed on the air outlet casing 10. The drive mechanism 320 and the drive member 310 may be transmission cooperated, so that the air guide mechanism 20 can be driven in an up-down movable manner. The drive mechanism 320 includes the gear transmission mechanism and the drive motor 3202. The gear transmission mechanism includes at least one gear 3201. The drive member 310 is a rack, and the gear 3201 located at an end of the gear transmission mechanism engages with the rack. The drive motor 3202 is coupled to the gear transmission mechanism to drive a movement of the gear transmission mechanism. When the drive motor 3202 drives the gear transmission mechanism to move, the gear 3201 at the end of the gear transmission mechanism engages with the rack to drive the rack up and down, thereby driving the air guide mechanism 20 up and down. Using such a way that the gear and rack cooperate to drive the air guide mechanism up and down, the structure is simple, has a stable transmission, and is more reliable.

The air outlet casing 10 has the air outlet cavity 103 in communication with the first air outlet 101, and the drive motor 3202 is disposed outside the air outlet cavity 103. The influence of air in the air outlet cavity 103 can be prevented from affecting the drive motor 3202 by disposing the drive motor 3202 outside the air outlet cavity 103. For example, when air flowing into the air outlet cavity 103 is humidified air, the air is humid, which will have a bad influence on the drive motor 3202. Therefore, this arrangement can avoid the influence of air in the air outlet cavity 103 on the drive motor 3202, improving a reliability of the drive motor 3202 and extending a service life of the drive motor 3202.

In one embodiment, at least a part of the gear transmission mechanism is disposed in the air outlet cavity 103. For example, an entire gear transmission mechanism may be disposed within the air outlet cavity 103. Alternatively, a part of the gear transmission mechanism may be disposed within the air outlet cavity 103 and another part of the gear transmission mechanism may be disposed outside the air outlet cavity 103. By disposing at least one portion of the gear transmission mechanism in the air outlet cavity 103, the overall structure is compact.

In one embodiment, with reference to FIG. 8, an outer side wall of the air outlet casing 10 may have a receiving groove 1102, which may penetrate through the side wall of the air outlet casing 10. The drive motor 3202 may be disposed outside the air outlet cavity 103 and contained within the receiving groove 1102, resulting in that the structure is compact.

In one embodiment, with reference to FIG. 9, the gear transmission mechanism includes a plurality of gears 3201 engaged in sequence. For example, the gear transmission mechanism includes three gears 3201 engaged in sequence. Thus, when the drive motor 3202 is disposed outside the air outlet cavity 103, by arranging the gear transmission mechanism as a structure including a plurality of gears 3201, the transmission cooperation between the gear transmission mechanism and the rack can be easily realized, and a more flexible structure design of the gear transmission mechanism can be made. The specification and size of each gear 3201 can be set to a smaller size to reduce a weight of the gear transmission mechanism.

For example, in the illustration of FIG. 8 and FIG. 9, the drive mechanism 320 also includes the drive box 3203. The gear transmission mechanism is disposed in the drive box 3203, and the gear transmission mechanism includes the plurality of gears 3201 engaged in sequence. The motor shaft of the drive motor 3202 extends into the drive box 3203 and is connected to the gears 3201 disposed at start end of the gear transmission mechanism. The air outlet cavity 103 is formed within the air outlet casing 10, and the outer side wall of the air outlet casing 10 may have the receiving groove 1102. The gears 3201 at the start end and a part of the drive box 3203 containing the gears 3201 at the start end are disposed in the receiving groove 1102. The rest of the gears 3201 and the rest part of the drive box 3203 are disposed in the air outlet cavity 103. The drive motor 3202 is disposed outside the air outlet cavity 103 and inside the receiving groove 1102. Thereby, the overall structure is compact and the air in the air outlet cavity 103 can be prevented from influencing on the drive motor 3202, which improves the reliability of the drive motor 3202 and extends the service life of the drive motor 3202.

Further, the air outlet casing 10 may include the casing body 110 and the air outlet component 120. The casing body 110 has a mounting opening 1101 formed at a top of the casing body 110. The air outlet component 120 is disposed at the mounting opening 1101. The first air outlet 101 is formed at the air outlet component 120. The air outlet cavity 103 is formed in the casing body 110 and the outer side wall of the casing body 110 may have the above-mentioned receiving groove 1102. A lower portion of the air outlet component 120 (e.g., the mounting member 1202 described below) is disposed in the air outlet cavity 103. The drive box 3203 is connected to the lower portion of the air outlet component 120 and the drive box 3203 is connected to the casing body 110. For example, the drive box 3203 is connected to the lower part of the air outlet component 120 by fasteners such as screws, and the drive box 3203 is connected to the casing body 110 by a snap structure, with a snap protrusion formed at the drive box 3203 and a receptacle formed at the casing body 110. A snap connection between the drive box 3203 and the casing body 110 can be achieved by matching the snap protrusion on the drive box 3203 to the receptacle on the casing body 110. By connecting the drive box 3203 to the lower portion of the air outlet component 120 and the drive box 3203 to the casing body 110, so that a mounting and fixing of the drive box 3203 is more stable and reliable.

It should be noted that the "plurality" in the present disclosure means two and more than two.

Figure 3:
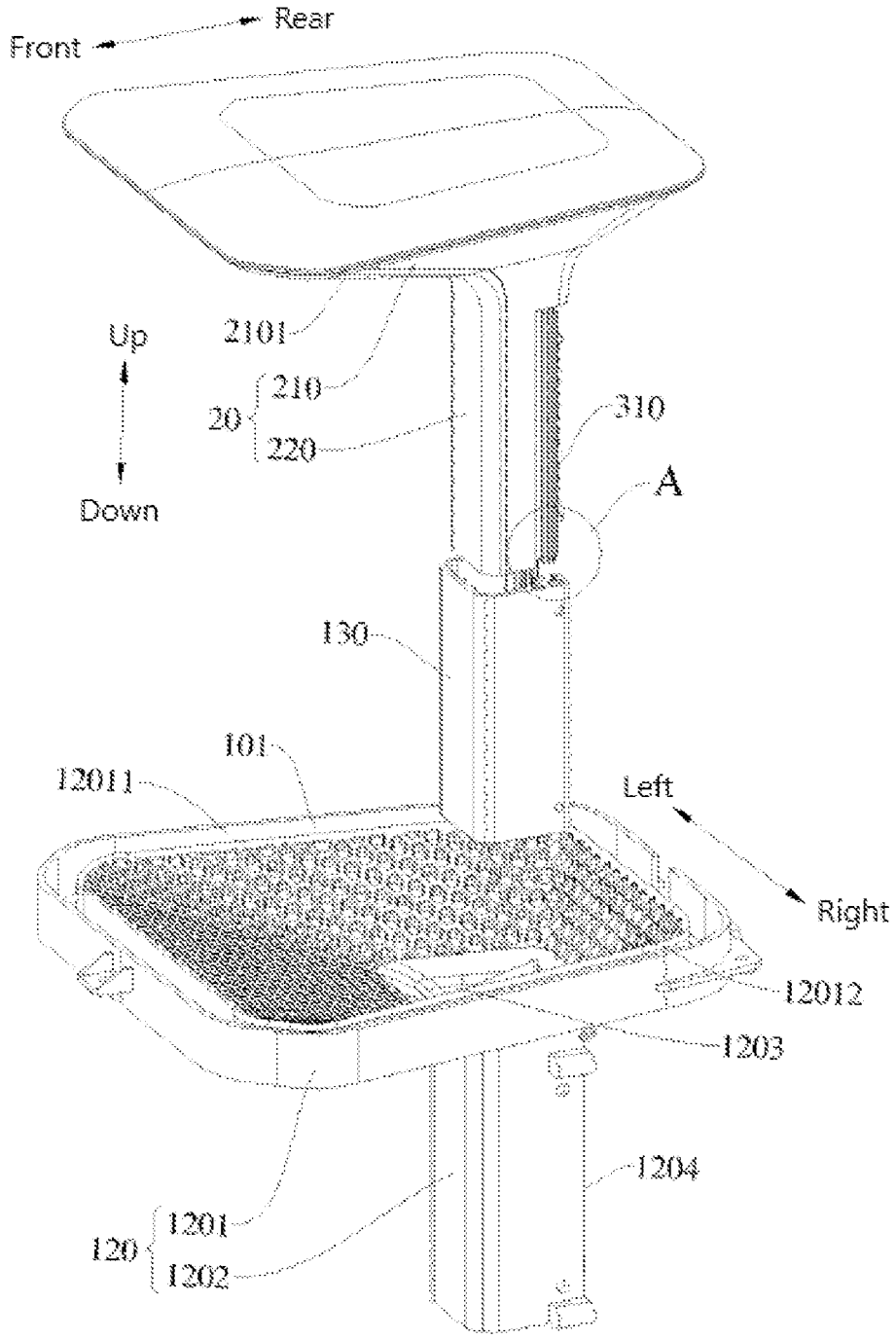
FIG. 3 is a second exploded schematic view of a part of a structure of an air treatment apparatus according to an embodiment of the present disclosure.

In some embodiments, as illustrated in FIG. 3 and FIG. 6, the air outlet component 120 may include the air outlet member 1201 and the mounting member 1202. The air outlet member 1201 may be disposed at the mounting opening 1101, and the air outlet member 1201 has the first air outlet 101. The mounting member 1202 may be connected to the lower portion of the air outlet member, and the drive mechanism 320 may be connected to the mounting member 1202 and connected to the lower portion of the air outlet member 1201. The air outlet component 120 is arranged to Ide the air outlet member 1201 and the mounting member 1202, which facilitates the formation of the first air outlet 101 and at the same time facilitates the mounting and fixing of the drive mechanism 320, resulting in that the overall structure is compact. In addition, as the drive mechanism is connected to the lower portion of the air outlet member 1201, air flowing into the casing body 110 can partially pass through the drive mechanism 320 during the process of flowing into the air outlet member 1201 to achieve a heat dissipation of the drive mechanism 320.

Further, in a horizontal plane, both a projection of the mounting member 1202 and a projection of the drive mechanism 320 are located within an outer contour line of a projection of the air outlet member 1201. In short, the mounting member 1202 and the drive mechanism 320 do not protrude from the air outlet member 1201 in a horizontal direction, so that the structure layout is compact and internal space of the air outlet casing 10 is saved.

In some embodiments, as illustrated in FIG. 3, the air outlet member 1201 includes the air outlet grille disposed at the first air outlet 101. The air outlet grille includes at least one air outlet sub-grille 12011 obliquely arranged, and the air outlet sub-grille 12011 obliquely arranged extends upwardly and obliquely in the direction from the connection between the air outlet member 1201 and the mounting member 1202 to the outer edge of the air outlet member 1201. When the air guide mechanism 20 fits into the air outlet member 1201, an air outlet sub-grille 12011 obliquely extended facilitates the air guide mechanism 20 to fit onto the air outlet member 1201, making a positioning mounting between the air guide mechanism 20 and the air outlet member 1201 more reliable. The air outlet grille is arranged to include at least one air outlet sub-grille 12011 obliquely arranged, and the drive mechanism 320 is disposed below the air outlet sub-grille 12011 obliquely arranged. The air outlet sub-grille 12011 obliquely arranged can provide more mounting space for the drive mechanism 320, and the drive mechanism 320 can be hidden, which achieves that the layout is compact and the space is saved.

In one embodiment, as illustrated in FIG. 3, the air outlet grille includes a plurality of air outlet sub-grilles 12011 obliquely arranged. The drive mechanism 320 is disposed below an air outlet sub-grille 12011 with a largest obliquity angle, and an obliquity angle is an angle between an air outlet sub-grille 12011 and the horizontal plane. More space is available below the sub-outlet grille 12011 with the largest obliquity angle compared to the others, so that more space can be provided for the drive mechanism 320. The drive mechanism 320 can be mounted at this position to achieve that the layout is compact and the space is saved.

In some exemplary embodiments, as illustrated in FIG. 3, the air outlet grille includes four air outlet sub-grilles 12011. Two of the air outlet sub-grilles 12011 cover a left portion and a right portion of the first air outlet 101, and the other two air outlet sub-grilles 12011 cover a front portion and a rear portion of the first air outlet 101. The air outlet sub-grille 12011 covering the rear portion of the first air outlet 101 having the largest obliquity angle. Four air outlet sub-grilles 12011 obliquely arranged are configured to form a groove structure at the first air outlet 101 of the air outlet member 1201 to facilitate the air guide mechanism 20 to fit onto the air outlet member 1201 when the device is covered. The air outlet sub-grille 12011 covering the rear portion of the first air outlet 101 has the largest obliquity angle, and more space can be provided in a height direction below this position. The drive mechanism 320 is disposed below the position to facilitate the mounting and fixing of the drive mechanism 320, which can achieve a greater degree of the compact layout and save more space, and can reduce influence on the air outlet to facilitate the air flowing out from the front portion.

In some examples, the air outlet component 120 may be detachably disposed at the mounting opening 1101. Since the drive mechanism 320 is disposed on the air outlet component 120, the air outlet component 120 being detachably disposed at the mounting opening 1101 makes it easy to remove, maintain and replace the drive mechanism 320. Moreover, it is convenient to maintain or replace the air outlet component 120 for a longer service life. The air outlet component 120 and the mounting opening 1101 may be connected by screws or bolts, and may also be removable by the snap structure, e.g., one of the air outlet component 120 and the mounting opening 1101 is disposed with the receptacle (not illustrated in the figure), and the other is disposed with the snap protrusion (not illustrated in the figure), which can also achieve quick assembly and disassembly.

In some embodiments, as illustrated in FIG. 2, the air outlet casing 10 also includes the air guide mechanism mounting bracket 140. The air guide mechanism mounting bracket 140 is disposed on the casing body 110, and the air outlet component 120 is detachably disposed on the air guide mechanism mounting bracket 140. The air outlet component 120 and the air guide mechanism mounting bracket 140 can be removed by means of screws or bolts, or by means of the snap structure with the snap protrusion in conjunction with the receptacle, which will not be described here.

In some embodiments, as illustrated in FIG. 3 and FIG. 6, the air guide mechanism 20 may include the air guide component 210 and the mounting base 220. The air guide component 210 is configured to cover or expose the first air outlet 101. The mounting base 220 may be connected to the lower portion of the air guide component 210, and the drive member 310 may be disposed on the mounting base 220. By arranging the air guide mechanism 20 to include the air guide component 210 and the mounting base 220, the air guide mechanism 20 exposes or covers the first air outlet 101 while facilitating the mounting and fixing of the air guide mechanism 20.

In some embodiments, as illustrated in FIG. 3 and FIG. 6, a side of the air guide component 210 near the air outlet member 1201 is formed with an air guide ramp 2101 that fits the air outlet sub-grille 12011. When air flows out from the air outlet sub-grille 12011, the air guide ramp 2101 can guide the air to flow out obliquely-upward from the first air outlet 101, bringing a better air guide effect.

In some embodiments, as illustrated in FIG. 3, the outlet grille includes the plurality of air outlet sub-grilles 12011 obliquely arranged. The air guide component 210 includes a plurality of air guide ramps 2101. Each air guide ramp 2101 corresponds to and fits with each air outlet sub-grille 12011.

Further, as illustrated in FIG. 3 and FIG. 6, the air outlet component 120 includes the air outlet member 1201 and the mounting member 1202. The air outlet member 1201 is disposed at the mounting opening 1101, and the air outlet member 1201 has the first air outlet 101. The mounting member 1202 is connected to the lower portion of the air outlet member, and the drive mechanism 320 is connected to the mounting member 1202. The receiving cavity 1203 having an open top is formed in the mounting member 1202, and the mounting base 220 is disposed in the receiving cavity 1203 in an up-down movable manner. The receiving cavity 1203 is opened toward a side of the drive mechanism 320 to form a first opening 1204. The drive member 310 is disposed opposite the first opening 1204 or is located at the first opening 1204. The drive member 310 may be disposed inside the receiving cavity 1203 together with the mounting base 220. The drive mechanism 320 may partially engage in a drivable coupling with the drive member 310 through the first opening 1204. Alternatively, the drive member 310 is disposed at the first opening 1204 and the drive mechanism 320 engages in a drivable coupling with the drive member 310 at an outside of the first opening 1204.

In some embodiments, as illustrated in FIG. 6, the air treatment apparatus 200 includes a mounting component 60 disposed in the air guide mechanism 20, and both the mounting component 60 and the air guide mechanism 20 are independently molded components, i.e., the mounting component 60 and the air guide mechanism 20 are two separate components, which can reduce manufacturing complexity and realize modular mounting. The drive assembly 30 includes the drive member 310 and the drive mechanism 320. The drive member 310 is disposed on the mounting component 60, and the drive member 310 is integrally molded with the mounting component 60, which further reduces the manufacturing complexity and can reduce mold opening. The drive member 310 and the mounting component 60 together achieve modular mounting with the air guide mechanism 20. The drive mechanism 320 is disposed in the air outlet casing 10, and the drive mechanism 320 is engaged with the drive part 310 in a drivable manner to drive the drive part 310 up and down.

In one embodiment, as illustrated in FIG. 6, the air guide mechanism 20 includes the air guide component 210 and the mounting base 220. The air guide component 210 is configured to cover or expose the first air outlet 101, and the mounting base 220 is connected to the lower portion of the air guide component 210. The mounting notch 202 is formed at the mounting base 220, and the mounting component 60 is disposed in the mounting notch 202. The mounting component 60 is fitted with the air guide mechanism 20 by being mounted at the mounting notch 202, resulting in that overall size of the mounting component 60 and the air guide mechanism 20 is small and compact, and the space is saved.

Further, as illustrated in FIG. 7, the mounting component 60 is detachably connected to the air guide mechanism 20, so that the mounting component 60 and the air guide mechanism 20 can be easily disassembled, installed, or replaced. If the mounting component 60 or the drive member 310 is damaged, it is not necessary to replace an entire air guide mechanism 20, but only to remove and replace the mounting component 60, which is simple and convenient and can significantly cut costs. The mounting component 60 has an alignment protrusion 601, and the air guide mechanism 20 has an alignment groove (not illustrated in the figure). The alignment protrusion 601 is configured to accommodate in the alignment groove, and the alignment protrusion 601 is arc-shaped. The alignment groove and the alignment protrusion 601 cooperate with each other to provide a pre-alignment function for the mounting component 60, so that the mounting component 60 can be mounted to the air guide mechanism 20 more easily and accurately.

In some embodiments, as illustrated in FIG. 7, the mounting component 60 and the air guide mechanism 20 are detachably connected by bolts, such as the air guide mechanism 20 has threaded holes (not illustrated in the figure), and the mounting component 60 has a first mounting hole 602. The mounting component 60 fits into the alignment groove on the air guide mechanism 20 through the alignment protrusion 601, and then the bolt passes through the first mounting hole 602 and fits into the threaded hole, so that the mounting component 60 and the air guide mechanism 20 can be disassembled and mounted.

In some examples, as illustrated in FIG. 7, a plurality of threaded holes may be provided in the air guide mechanism 20. A plurality of first mounting holes 602 may be provided in the mounting component 60. The plurality of first mounting holes 602 one-to-one correspond to the plurality of threaded holes in equal numbers, which bolt-on connection is reliable and relatively easy to disassemble and mount.

Exemplarily, as illustrated in FIG. 7, the threaded holes on the air guide mechanism 20 are provided with three in an up-down direction, and the first mounting holes 602 on the mounting component 60 are provided with three in an up-down direction. The three first mounting holes 602 are disposed sequentially at upper, middle, and lower ends of the mounting component 60. The three threaded holes and the three first mounting holes 602 are bolted together to secure the upper, middle, and lower ends of the mounting component 60, making a more stable mounting.

In other examples, the mounting component 60 is detachably connected to the air guide mechanism 20 by means of a snap, e.g., the air guide mechanism 20 has the receptacle (not illustrated in the figure) and the mounting component 60 has the snap protrusion (not illustrated in the figure), and the receptacle and snap protrusion cooperate with each other to achieve mounting or disassembly. The number of snap protrusions and receptacles may be provided in a plurality to improve connection reliability.

In some examples, as illustrated in FIG. 7, the two alignment protrusions 601 are spaced apart from top to bottom, and the two alignment protrusions 601 protrude in a direction away from each other, with an upper alignment protrusion 601 bending upward and a lower alignment protrusion 601 bending downward. Since the alignment protrusions 601 are arc-shaped, two alignment protrusions 601 protruding in the direction away from each other can be easily fit into the alignment grooves by using protruding arc-shaped portions, making the alignment easier. Moreover, it may be understood that the two alignment protrusions 601 are disposed symmetrically, which makes it possible to mount the mounting component 60 to the air guide mechanism 20 when the mounting component 60 is mounted whether forward or reverse 180 degrees, and therefore provides a fool-proof function.

In one embodiment, as illustrated in FIG. 1, at least one second air outlet 102 is formed at a circumferential side wall of the air outlet casing 10 to achieve a lateral air outlet of the air treatment apparatus 200. In exemplary examples, two second air outlets 102 may be formed at the circumferential side wall of the air outlet casing 10. Since the first air outlet 101 is formed at the top of the air outlet casing 10, the air treatment apparatus 200 can achieve both top and lateral air outlet. In other examples, the circumferential side walls of the air outlet casing 10 are disposed with the second air outlet 102 on two opposite side walls. Since the first air outlet 101 is formed at the top of the air outlet casing 10, the air treatment apparatus 200 can realize the top air outlet and the bilateral air outlets in a horizontal direction, thus bringing a more diverse air outlet effect, more three-dimensional and multi-dimensional air outlet, and a larger air outlet, which is conducive to better and faster regulation of an indoor.

Figure 4:
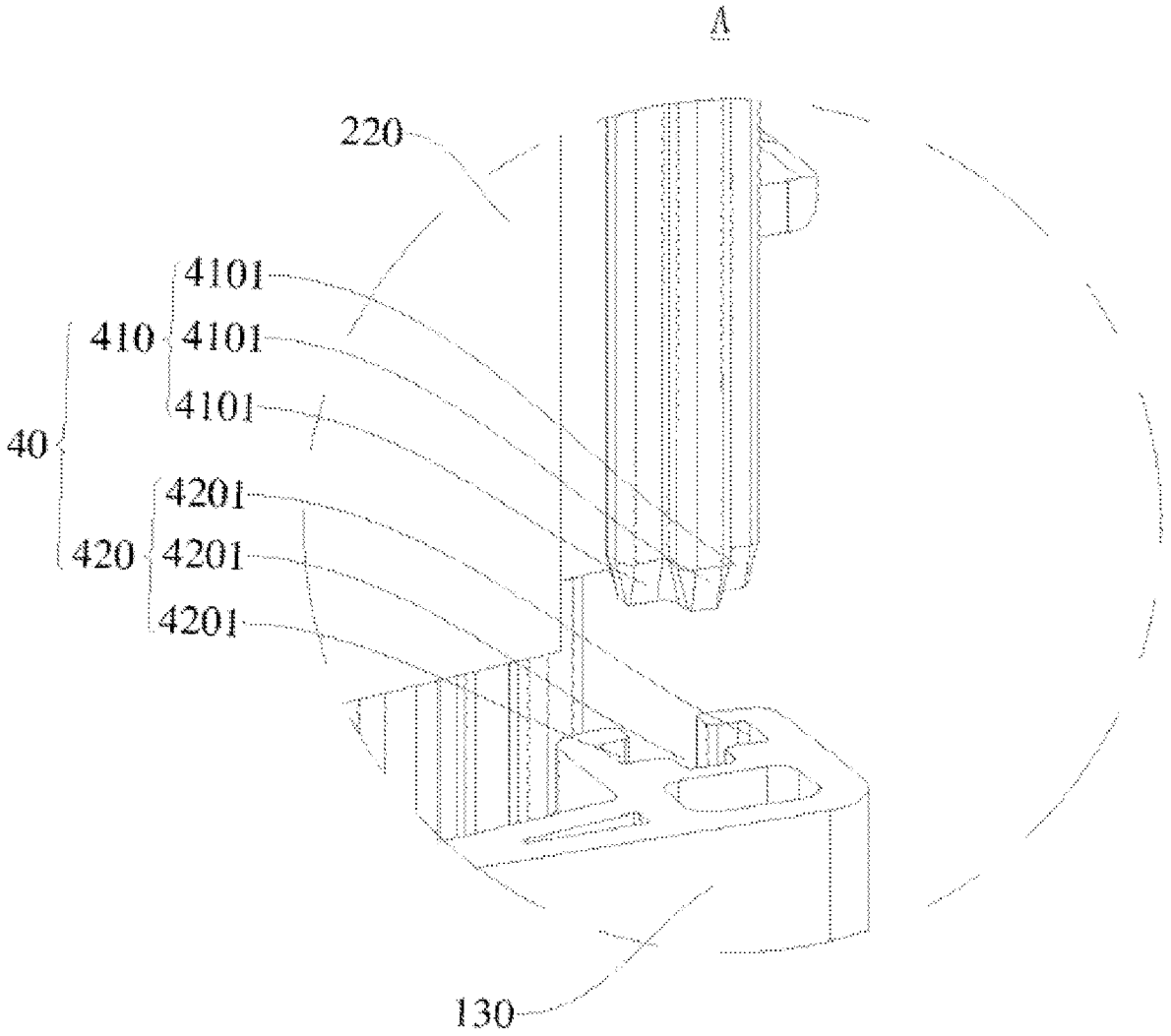
FIG. 4 is a partially enlarged schematic diagram of A in FIG. 3.
Figure 5:
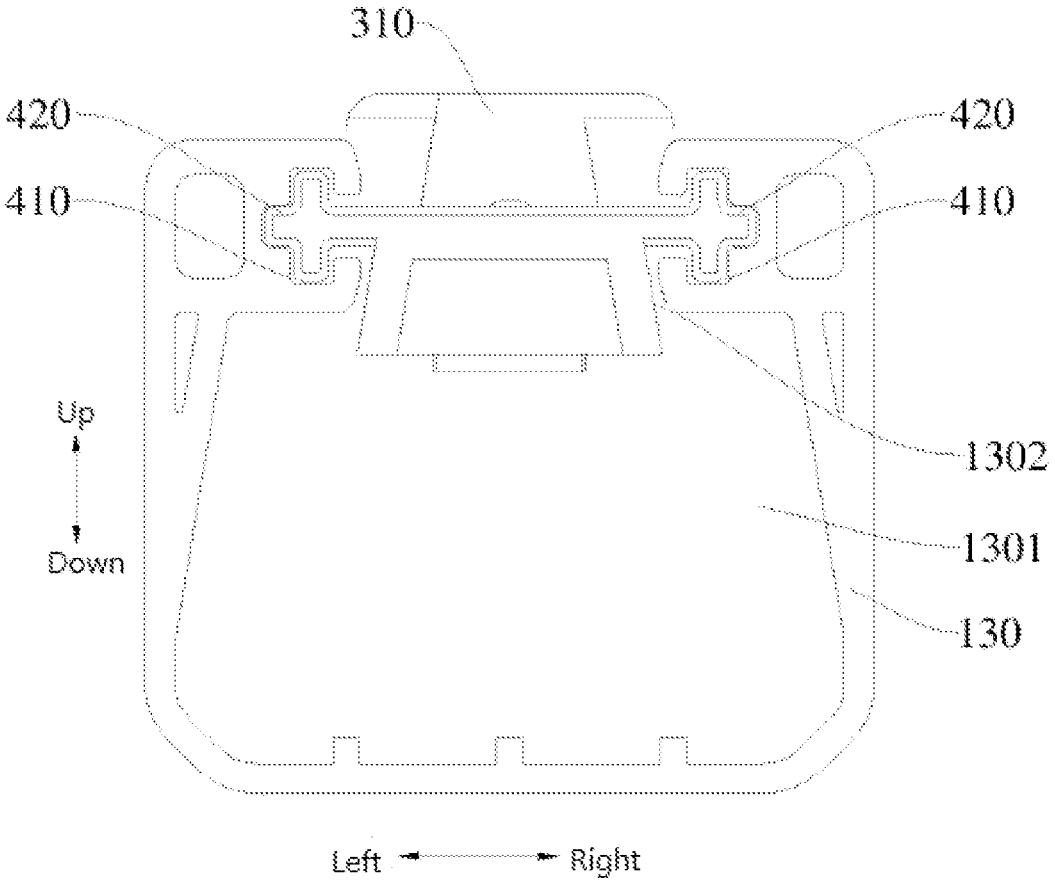
FIG. 5 is a schematic diagram of a cooperation between the drive member and the guide component according to an embodiment of the present disclosure.

In some embodiments of the present disclosure, as illustrated in FIG. 3 to FIG. 5, the air treatment apparatus 200 further includes a guide structure 40. The guide structure 40 includes a first guide member 410 and a second guide member 420 that cooperate with each other. The first guide member 410 is disposed in the air guide mechanism 20 and extends in an up-down direction, and the second guide member 420 is disposed in the air outlet casing 10 and extends in an up-down direction. In a process of moving the air guide mechanism 20 up and down to expose or cover the first air outlet 101, stability and reliability in movement of the air guide mechanism 20 can be improved by cooperating the first guide member 410 on the air guide mechanism 20 with the second guide member 420 on the air outlet casing 10.

Further, as illustrated in FIG. 6, the first guide member 410 is disposed on the mounting component 60, and the first guide member 410 is integrally molded with the mounting component 60. In this way, the first guide member 410 and the mounting component 60 can realize the module assembly with the air guide mechanism 20, which can reduce the manufacturing complexity.

In some embodiments, as illustrated in FIG. 6, the drive member 310, the first guide member 410 and the mounting component 60 are integrally molded, which enables the modular mounting of all three and further reduces the manufacturing complexity.

In some embodiments, as illustrated in FIG. 5, two first guide members 410 and two second guide members 420 are provided, and the two first guide members 410 are disposed on opposite ends of the mounting component 60 and at opposite sides of the drive member 310. By disposing the two first guide members 410 on each opposite end of the mounting member 60, it can provide a balanced guide for the up-down movement of the air guide mechanism 20 on both sides and ensure a stable and reliable guide process.

Exemplarily, as illustrated in FIG. 5, the left end and the right end of the mounting component 60 are respectively provided with a first guide member 410, and the two first guide parts 410 are located on the left and right sides of the driving part 310, to provide a balanced guiding effect for the movement of the drive member 310.

In a further embodiment, as illustrated in FIG. 4, the first guide member 410 includes a plurality of ribs 4101 extending in an up-down direction and the plurality of ribs 4101 have different protrusion directions. The second guide member 420 includes a plurality of grooves 4201 extending in an up-down direction and the number of grooves 4201 is the same as the number of ribs 4101 in one-to-one correspondence. Each of the ribs 4101 is disposed in the corresponding groove 4201 in an up-down movable manner. The plurality of ribs 4101 and grooves 4201 cooperate to guide the air guide mechanism 20 to move up and down. The plurality of ribs 4101 protrudes in different directions, which can not only guide and limit in several directions but also increase a guide contact surface to provide a more stable guide and enhance guide reliability.

In one embodiment, as illustrated in FIG. 4, three ribs 4101 are arranged and connected in sequence, two adjacent ribs 4101 are disposed substantially perpendicular to each other, and three grooves 4201 are connected to each other. For example, the three ribs 4101 may form a structure similar to a T-shaped, and the three grooves 4201 may accordingly form a cross-shaped. The middle rib 4101 of the three ribs 4101 faces the front, and the two remaining ribs 4101 are disposed at a left and right side. The three ribs 4101 can achieve a front-rear direction and a left-right direction guiding limit, providing a better guiding effect. The above is only an example, not limited to this, such as the ribs 4101 may also be sequentially arranged and connected four or five, etc., and will not be repeated here.

In some examples, as illustrated in FIG. 7, the air treatment apparatus 200 includes a limiting structure for limiting the air guide mechanism 20 in the up-down direction. The limiting structure includes a first limit protrusion 510, a second limit protrusion 520, and a third limit protrusion 530. The first limit protrusion 510 and the second limit protrusion 520 are disposed on the air guide mechanism 20, and the first limit protrusion 510 and the second limit protrusion 520 are disposed on an upper and lower side of the drive member 310, respectively. The third limit protrusion 530 is disposed on the drive mechanism 320, and the third limit protrusion 530 is configured to engage with the first limit protrusion 510 and the second limit protrusion 520 in the up-down direction. The limiting structure enables the air guide mechanism 20 to move within a predetermined height range, and the air guide mechanism 20 can stop moving down when it returns to a starting position and stop moving up when it reaches a predetermined height position.

In a further embodiment, when the drive mechanism 320 drives the drive member 310 upward, the drive member 310 drives the air guide mechanism 20 upward and exposes the first air outlet 101. As the drive member 310 continues to move upward, the second limit protrusion 520 on the lower side of the drive member 310 engages with the third limit protrusion 530 on the drive mechanism 320, which makes the drive member 310 unable to continue to move upward and stops the drive mechanism 320. At this time, the air guide mechanism 20 reaches the predetermined height. When the drive mechanism 320 drives the drive member 310 downward, the drive member 310 drives the air guide mechanism 20 to move downward and gradually covers the first air outlet 101. When the first limit protrusion 510 on the upper side of the drive member 310 engages with the third limit protrusion 530 on the drive mechanism 320, the drive member 310 is unable to continue to move downward and the drive mechanism 320 stops driving. At this time, the air guide mechanism 20 returns to the starting position to stop and completely cover the first air outlet 101. The above way has a simple structure, only a distance between the first limit protrusion 510, the second limit protrusion 520 and the third limit protrusion 530 needs to be provided accordingly according to the predetermined height range, which can easily achieve a height limit for the lifting and lowering of the air guide mechanism 20.

In some embodiments, as illustrated in FIG. 7, two third limit protrusions 530 are provided, and are disposed on opposite sides of the avoidance opening 301 in a horizontal direction. The two third limit protrusions 530 disposed in this way are closer to the gear 3201, and a lower limit position and an upper limit position of the air guide mechanism 20 occur at the avoidance opening 301, which can reduce a length of the rack while meeting requirements of the upper and lower limits, and can provide a smaller size of the air guide mechanism 20 in the up-down direction. Meanwhile, the two third limit protrusions 530 may also increase a contact surface with the first limit protrusion 510 or the second limit protrusion 520, thereby enhancing limiting reliability.

In another embodiment, as illustrated in FIG. 6 and FIG. 7, the drive box 3203 includes a first box body 32031 and a second box body 32032. The first box body 32031 is provided with a box-body locking protrusion 303 and the second box body 32032 is provided with a box-body locking hole 304. The box-body locking protrusion 303 and box-body locking hole 304 cooperate with each other to realize the disassembly and mounting of the first box body 32031 and the second box body 32032, which is simple and convenient to operate.

In other examples, as illustrated in FIG. 6 and FIG. 7, the first box body 32031 is provided with a screw post 305 and the second box body 32032 has a screw hole (not illustrated in the figure). When the first box body 32031 and the second box body 32032 are assembled, the screw post 305 and the screw hole cooperate with each other to achieve alignment and ensure that the first box body 32031 and the second box body 32032 can be accurately assembled.

In other embodiments, the drive assembly 30 may also be a screw-nut lifting device, i.e., the drive assembly 30 includes a drive member 310 and a drive mechanism 320. The drive member 310 is a connecting block, the drive mechanism 320 is a motor (not illustrated in the figure), a screw (not illustrated in the figure) connected to the motor, and a nut (not illustrated in the figure) mounted on the screw. The nut is rotated and mounted on the connecting block. In exemplary operation, the motor drives the screw to rotate, and the screw drives the nut to move upward or downward, which in turn drives the connecting block to move, to realize the upward and downward movement of the air guide mechanism 20. The drive assembly 30 may also be other lifting or moving devices, not limited to this, such as the drive assembly 30 may be an electric actuator drive lifting way, and will not be repeated here.

In a further embodiment, as illustrated in FIG. 1 and FIG. 3, the air outlet casing 10 also includes a guide component 130. The guide component 130 is disposed on the air outlet component 120, and the second guide member 420 is formed at the guide component 130. Both the guide component 130 and the air outlet component 120 are independently molded components. By providing the guide component 130 and the air outlet component 120 as independent molded components, it is convenient for the disassembly, maintenance, and replacement of the guide component 130, which can realize the module assembly and reduce the manufacturing complexity.

Further, as illustrated in FIG. 5, the guide component 130 is disposed in the receiving cavity 1203. The guide component 130 has a guide cavity 1301. The mounting base 220 is disposed in the guide cavity 1301 in an up-down movable manner. The guide cavity 1301 is open toward the side of the drive mechanism 320 to form a second opening 1302 corresponding to the first opening 1204. The first opening 1204 and the second opening 1302 are configured to provide an avoidance space to realize the transmission cooperation between the drive member 310 and the drive mechanism 320.

In some embodiments of the present disclosure, at least one second air outlet 102 is formed at the circumferential side wall of the air outlet casing 10. For example, two second air outlets 102 may be provided, and the two second air outlets 102 may be disposed on a left and right side of the air outlet casing 10. The housing has a second vent 809 opposite and in communication with the second air outlet 102. When the air guide mechanism 20 exposes the first air outlet 101, air flows into the air outlet cavity 103 of the air outlet casing 10 after being treated by the air treatment unit 2. The air in the air outlet cavity 103 can flow out from the first air outlet 101 on the top and the second air outlets 102 on the left and right sides. The air flows into the air outlet chamber 811 from the first air outlet 101 on the top and flows into the indoor space through the first vent 808. The air from the second air outlet 102 flows into the indoor space through the second vent 809, resulting in a larger air outlet range and a more three-dimensional air outlet. Controlling whether the air guide mechanism 20 exposes the first air outlet 101 or not may change the air outlet effect. When the air guide mechanism 20 covers the first air outlet 101, the air may flow out from the second air outlet 102 to achieve air from the left and right sides. And when a user has a need that air flows out from the first vent 808, controlling the air guide mechanism 20 to open the first air outlet 101 may realize the air flow from the left and right side and the top of the air treatment device 200 at the same time.

In one embodiment, with reference to FIG. 11 to FIG. 14, an air guide plate 810 is disposed at the second vent 809 and is configured to cover or expose the second vent 809. The air guide plate 810 disposed at the second vent 809 can easily cover or expose the second vent 809, thus making more diversified air outlet methods and more diversified air outlet effects. For example, when only the first vent 808 is needed, the air guide mechanism 20 exposes the first air outlet 101 and the air guide plate 810 covers the second vent 809. When only the second vent 809 is needed, the air guide mechanism 20 covers the first air outlet 101 and the air guide plate 810 exposes the second vent 809. When both the first vent 808 and the second vent 809 are needed, the air guide 20 exposes the first air outlet 101 and the air guide plate 810 exposes the second vent 809.

In some embodiments of the present disclosure, with reference to FIG. 11 and FIG. 12, the air treatment unit 2 includes a first fan component 21, a humidification component 22, and a purification component 23. The first fan component 21 is configured to drive air into the air treatment apparatus 200 from the at least one air inlet 201, and is configured to drive air into the air treatment unit 20 from the at least one air inlet 201. The humidification component 22 is disposed in the air outlet casing 10, and the air outlet cavity 103 is formed between the humidification component 22 and the air outlet casing 10. The purification component 23 is disposed between the air outlet casing 10 and the first fan component 21. The purification component 23 has a purification cavity in communication with the air outlet cavity 103. Disposing the air treatment unit 2 as humidification component 22 and purification component 23 can make the air treatment unit 2 have humidifying and purifying functions for air. And disposing the humidification component 22 in the air outlet casing 10, resulting in that the structure of the air treatment apparatus 200 is compact. When the air treatment apparatus 200 is in operation, the first fan component 21 drives air from the at least one air inlet 201 into the first fan component 21, and then flows through the purification component 23 for purification. Purified air flows into the air outlet cavity 103 of the air outlet casing 10. The air may flow to the first air outlet 101 after being humidified by the humidification component 22, and the air may also flow directly to the first air outlet 101 without being humidified by the humidification component 22.

In some embodiments of the present disclosure, with reference to FIG. 11 and FIG. 12, the first fan component 21, the purification component 23 and the air outlet casing 10 are sequentially arranged from bottom to top. The first fan component 21, the purification component 23 and the air outlet casing 10 from bottom to top are arranged, resulting in that the structure of the air treatment apparatus 200 is reasonable and compact, and makes air from the at least one air inlet 201 into the first fan component 21 flow upward through the purification component 23 and then flow into the air outlet cavity 103 of the air outlet casing 10, which provides a shorter and smoother air flow path.

In some embodiments of the present disclosure, with reference to FIG. 11 and FIG. 12, the humidification component 22 includes a humidification bracket 222, a wet film bracket 223, a humidification film and a humidification water tank 221. A humidification sink is disposed in the humidification bracket 222, and the humidification bracket 222 is disposed in the air outlet casing 10 in a drawable manner. The wet film bracket 223 is disposed on the humidification bracket 222. The humidification film disposed in the wet film bracket 223 with a part of the humidification film disposed in the humidification sink, and water in the humidification water tank may penetrate the humidification film. The humidification water tank 221 is disposed in the humidification bracket 222 and is disposed on a side of the wet film bracket 223 facing away from the air outlet cavity 103. The humidification water tank 221 is configured to supply water to the humidification sink. Air flow into the air outlet cavity 103 may be humidified by the humidification film. Disposing the humidification water tank 221 on the side of the wet film bracket 223 facing away from the air outlet cavity 103 makes a reasonable layout of the components and reduces influence on the air outlet. In addition, by disposing the humidification bracket 222 in the air outlet casing 10 in a drawable manner and disposing the humidification water tank 221 in the humidification bracket 222, when water is needed, the humidification bracket 222 may be drawn out of the air outlet casing 10 to facilitate adding water to the humidification water tank 221. For example, the humidification water tank 221 may be disposed on the front side of the air outlet casing 10, and the humidification bracket 222 may be drawable forward and backward in the air outlet casing 10, which may make the lower panel 8012 easy to add water to the humidification water tank 221 by drawing the humidification bracket 222 when the removal opening 8021 is exposed. The humidification water tank 221 may be removed from the humidification bracket 222, e.g., the humidification water tank 221 may be removed from the humidification bracket 222 by lifting upward, further facilitating adding water to the humidification water tank 221.

Further, the air outlet casing 10 is disposed below the air outlet chamber 811, and the first air outlet 101 is disposed at the top of the air outlet casing 10. The air guide mechanism 20 is disposed in the air outlet casing 10 in an up-down movable manner. At least one second air outlet is formed at the circumferential side wall of the air outlet casing 10. The second vent 809 corresponding to and in communication with the second air outlet 102 is formed at the housing 800, and the humidification film is close to the second air outlet 102 and corresponding to the second air outlet 102. Thereby, air flow into the air outlet chamber 103, after being humidified by the humidification film, may then flow out through the second air outlet 102 and the second vent 809, while the air flow from the first air outlet 101 is not humidified by the humidification film, so that the air flow can be selectively humidified as needed.

For example, when the air guide plate 810 is disposed on the second vent 809, it is possible to choose whether to humidify the air according to need. When the air needs to be humidified, the second vent 809 can be exposed, and the air flows into the air outlet cavity 103, then flows out through the second air outlet 102 and the second vent 809 after being humidified by the humidification film to achieve humidification of the air. At this time, if the first air outlet 101 is covered, air purified by the purification component 23 flows into the air outlet cavity 103, after all being humidified by humidification film, and then the air flows out through the second air outlet 102 and the second vent 809. If the first air outlet 101 is exposed, the air purified by the purification component 23 flows into the air outlet cavity 103. After a part of air is humidified by humidification film, the air flows out through the second air outlet 102 and the second vent 809, or the other part flows out directly through the first air outlet 101 and the first vent 808 without being humidified. When the air does not need to be humidified, the second vent 809 is covered, the air purified by the purification component 23 flows into the air outlet cavity 103, and flows out directly through the first air outlet 101 and the first vent 808 without being humidified.

In some embodiments of the present disclosure, with reference to FIG. 11 and FIG. 12, the purification component 23 includes purification members 231 stacked in multiple layers along a direction of air flow. For example, the purification members 231 stacked in multiple layers may be arranged from top to bottom, and the purification member 231 in each layer is disposed in the purification cavity in a drawable manner. Accordingly, the purification component 23 is provided to include the purification members 231 stacked in multiple layers along the direction of air flow, which can improve the purification effect. The purification member 231 in each layer is disposed in the purification cavity in a drawable manner, which facilitates replacement of each layer of purification member 231. For example, each layer of the purification member 231 may be front-rear disposed in the purification cavity in a drawable manner, which may make the lower panel 8012 open a front side space of the air treatment apparatus 200, and the purification member 231 may be easily replaced by drawing the purification member 231.

In some embodiments of the present disclosure, with reference to FIG. 11 to FIG. 14, a plurality of air inlets 201 are provided. At least one air inlet 201 is configured to be in communication with outdoor air, and a remaining air inlet 201 of the plurality of air inlets 201 is configured to be in communication with indoor air. For example, with three air inlets 201, one of the air inlets 201 is connected to the outdoor air and the other two air inlets 201 are connected to the indoor air. In this way, the air treatment apparatus 200 can treat at least one of the introduced fresh air and the indoor air. For example, each air inlet 201 can be controlled to be covered or exposed. The air inlet 201 connected to the outdoor can be opened when fresh air needs to be introduced, and the air inlet 201 connected to the indoor air can be opened when the indoor air needs to be treated.

An exemplary embodiment of the air conditioner of the present disclosure is described below with reference to the accompanying drawings.

In the embodiment, the air conditioner is a split floor-standing air conditioner, the air conditioner includes the air conditioner indoor unit 1000 and the air conditioner outdoor unit. The air conditioner indoor unit 1000 includes the housing 800, the air treatment apparatus 200 and the air heat exchanger apparatus 700.

The housing 800 forms a first mounting cavity and a second mounting cavity separated above and below, and the housing 800 also forms the air outlet chamber 811. The air outlet chamber 811 is disposed between the first mounting cavity and the second mounting cavity, and the air outlet cavity 811 is separated from the first mounting cavity and is connected to the second mounting cavity. The air heat exchanger apparatus 700 is disposed in the first mounting cavity and the air treatment apparatus 200 is disposed in the second mounting cavity. The housing 800 includes the front panel 801, the air outlet frame component 802, the rear casing component 803, the top cover 804 and a chassis 805. The air outlet frame component 802 is connected to the rear box component 803 from front to rear. The front panel 801 is connected to the front side of the air outlet frame component 802. A heat exchanger air inlet 806 is formed in a corresponding part of the rear casing component 802 and the first mounting cavity. The heat exchanger air inlet 806 is connected to the indoor space.

The air treatment apparatus has three air inlets 201, one of which is connected to the indoor air and the other two are connected to the outdoor air. The air inlet 201 connected to the outdoor air extends outside the housing 800 through the rear casing component 803 and is connected to the outdoor air. Two indoor air inlets 812 corresponding to the other two air inlets 201 (which are connected to the indoor air) are formed at the rear casing component 803. The front panel 801 includes the upper panel 8011 and the lower panel 8012 that are spaced apart from top to bottom. The first vent 808 is formed between the upper panel 8011 and the lower panel 8012. The second vents 809 are formed at each of the left and right sides of the air outlet frame 802. The air guide plate 810 is disposed at the second vent 809 and is configured to cover or expose the second vent 809. The top cover 804 is connected to the top of the rear casing component 803 and the air outlet frame component 802. The chassis 805 is connected to the bottom of the rear casing component 803 and the air outlet frame component 802.

The air heat exchanger apparatus 700 includes the heat exchanger component 730 and the second fan component 720. The heat exchanger component 730 is disposed at the rear side of the second fan component 720. The second fan component 720 may include two cross-flow air wheels that are spaced apart from left to right, and the two cross-flow air wheels correspond to the two heat exchanger outlets 807, respectively.

The air treatment apparatus 200 includes the air treatment unit 2, the air outlet casing 10 and the air induction hood 70. The air induction hood 70 is disposed at the top of the air outlet casing 10. The air treatment unit 2 includes the first fan component 21, humidification component 22 and purification component 23, and the first fan component 21 has the three air inlets 201 described above. The purification component 23 is disposed on an air outlet side of the first fan component 21 and is disposed above the first fan component 21. The humidification component 22 is disposed in the air outlet casing 10. The humidification component 22 includes the humidification bracket 222, the wet film bracket 223, the humidification film and the humidification water tank 221. The humidification bracket 222 is disposed in the air outlet casing 10 in a drawable manner. The air outlet chamber 103 is formed between the humidification component 22 and an inner wall of the air outlet casing 10. The first air outlet 101 and the second air outlet 102 are both in communication with the air outlet chamber 103, and the humidification film of the humidification component 22 is disposed in the air outlet chamber 103. The humidification film of the humidification component 22 is close to the two second air outlets 102 and opposed to the two second air outlets 102. The air outlet component 120 of the air outlet casing 10 and the humidification component 22 are arranged in a front and rear direction of the casing body 110. For example, the humidification component 22 is disposed in the front of the casing body 110 and the air outlet component 120 is disposed in the rear of the casing body 110.

The first fan component 21 includes a scroll casing and a centrifugal turbine. The scroll casing is connected to the at least one air inlet 201, and the centrifugal turbine is disposed in the scroll casing. The scroll casing is connected to the purification cavity of the purification component 23, and the purification cavity is in communication with the air outlet cavity 103 of the air outlet casing 10. The air induction hood 70 is disposed at the top of the air outlet casing 10, and the air induction cavity 701 is formed between the top of the air outlet casing 10 and the air induction hood 70. The air induction cavity 701 has the air induction outlet, and the air induction outlet of the air induction cavity 701 is opposite to and connected with the first vent 808. When the air guide mechanism 20 is raised or lowered, a part of the air guide mechanism 20 may be accommodated in the air induction cavity 701.

The air treatment apparatus 200 may also include the drive assembly 30, the guide structure 40, the limiting structure, and the mounting component 60.

The air outlet casing 10 may include the casing body 110, the air outlet component 120, and the guide component 130.

The top of the casing body 110 may have the mounting opening 1101, and the second air outlet 102 is formed at each of the left side wall and right side wall of the casing body 110. The air outlet component 120 is detachably disposed in the mounting opening 1101, and the first air outlet 101 may be formed at the air outlet component 120. The guide component 130 is disposed in the air outlet component 120, and both the guide component 130 and the air outlet component 120 are independently molded components.

The air outlet component 120 may include the air outlet member 1201 and the mounting member 1202. The air outlet member 1201 may be disposed at the mounting opening 1101, and the first air outlet 101 may be formed at the air outlet member 1201. The mounting member 1202 may be connected to the lower portion of the air outlet member 1201, and the mounting member 1202 may form the receiving cavity 1203. The guide component 130 may be up-down moved in the receiving cavity 1203.

The air outlet member 1201 may include the air outlet grille disposed at the first air outlet 101, and the air outlet grille may include four air outlet sub-grilles 12011 obliquely arranged. The air outlet sub-grille 12011 obliquely arranged extends upwardly and obliquely in the direction from a center of the air outlet member 1201 to the outer edge of the air outlet member 1201. Two air outlet sub-grilles 12011 may be disposed at left and right ends of the first air outlet 101, and the remaining two air outlet sub-grilles 12011 may be disposed at front and rear ends of the first air outlet 101. The remaining two air outlet sub-grilles 12011 may be located at the front and rear ends of the first air outlet 101. The air outlet sub-grille 12011 covering the rear portion of the first air outlet 101 has the largest obliquity angle, and the drive mechanism 320 is disposed below the air outlet sub-grille 12011 with the largest obliquity angle. The obliquity angle is the angle between the air outlet sub-grille 12011 and the horizontal plane.

The side of the air guide component 210 near the air outlet member 1201 is formed with four air guide ramps 2101 that fit the air outlet sub-grilles 12011.

The air guide mechanism 20 may be disposed in the air outlet casing 10 in an up-down movable manner, to cover or expose the first air outlet 101.

The air guide mechanism 20 may include the air guide component 210 and the mounting base 220. The air guide component 210 may be configured to cover or expose the first air outlet 101. The mounting base 220 may be connected to the lower portion of the air guide component 210, and the mounting base 220 may be up-down moved in the receiving cavity 1203.

The mounting base 220 may have the mounting notch 202, and the mounting component 60 may be disposed within the mounting notch 202.

The alignment groove (not illustrated in the figure) may be formed in the mounting base 220. The mounting component 60 may be formed with the alignment protrusion 601, and the alignment protrusion 601 may be disposed within the alignment groove. The two alignment protrusions 601 may be spaced apart from top to bottom, and the two alignment protrusions 601 may protrude in a direction away from each other.

The mounting base 220 may be configured as three threaded holes along the up-down direction, and the mounting component 60 may be disposed with three first mounting holes 602 along the up-down direction, with the three first mounting holes 602 being disposed at the upper, middle, and lower ends of the mounting component 60 in sequence.

The drive assembly 30 may be configured to drive the air guide mechanism 20 up and down.

The drive assembly 30 may include the drive member 310 and the drive mechanism 320.

The drive member 310 may be the rack, and the rack may be disposed on the mounting component 60. The drive mechanism 320 may include the gear 3201, the drive motor 3202 and the drive box 3203. The gear 3201 may be engaged with the rack, and the drive motor 3202 may be connected to the gear 3201 to drive the movement of the gear 3201. The drive box 3203 may have the avoidance opening 301, and the tooth portion of the gear 3201 may extend outside the drive box 3203 through the avoidance opening 301. The drive box 3203 is detachably disposed on the mounting member 1202. The receiving cavity 1203 of the mounting member 1202 may be open toward the side of the drive mechanism 320 to form the first opening 1204, and the guide cavity 1301 may be open toward the side of the drive mechanism 320 to form the second opening 1302 correspondingly disposed with the first opening 1204. The drive member 310 may be disposed at the second opening 1302.

In the horizontal plane, both the projection of the mounting member 1202 and the projection of the drive mechanism 320 are located within the outer contour line of the projection of the air outlet member 1201.

The drive box 3203 has the second mounting hole 302, and the air outlet component 120 has the threaded hole.

Fastener is penetrated through the second mounting hole 302 and fits over the threaded hole.

The drive box 3203 may include the first box body 32031 and the second box body 32032. The first box body 32031 is disposed with the box-body locking protrusion 303 and the second box body 32032 is disposed with the box-body locking hole 304. The first box body 32031 has the screw post 305 and the second box body 32032 has the screw hole.

The guide structure 40 may include the first guide member 410 and the second guide member 420 that cooperate with each other. The first guide member 410 may extend in the up-down direction and the second guide member 420 may extend in the up-down direction.

The first guide member 410 may be disposed on the mounting component 60, and the left and right ends of the mounting component 60 may be disposed with the first guide member 410. The drive member 310, the first guide member 410, and the mounting component 60 are integrally formed. The second guide member 420 may be disposed on the guide component 130.

The first guide member 410 includes three ribs 4101 extending in the up-down direction and the three ribs 4101 have different protrusion directions. The second guide member 420 includes three grooves 4201 extending in the up-down direction and the number of grooves 4201 is the same as the number of ribs 4101 in one-to-one correspondence. Each of the ribs 4101 is disposed in the corresponding groove 4201 in an up-down movable manner.

The three ribs 4101 may be sequentially arranged and sequentially connected, two adjacent ribs 4101 are disposed approximately perpendicular to each other, and the grooves 4201 are three and connected to each other.

The limiting structure may include the first limit protrusion 510, the second limit protrusion 520 and the third limit protrusion 530.

The first limit protrusion 510 and the second limit protrusion 520 may be disposed at the upper and lower ends of the mounting component 60. The first limit protrusion 510 and the second limit protrusion 520 may be disposed at the upper and lower sides of the drive member 310, respectively. Two third limit protrusion 530 may be provided, and the two third limit protrusions 530 may be disposed on opposite sides in the horizontal direction of the avoidance opening 301.

Two second air outlets 102 can be formed at the left and right side walls of the air outlet casing 10, and the two second air outlets 102 are opposite and in communication with the second air outlet 809.

When the air conditioner is in operation, one of the air treatment apparatus 200 and the air heat exchanger apparatus 700 can be controlled to operate, or both the air treatment apparatus 200 and the air heat exchange apparatus 700 can be controlled to operate.

When only the air heat exchanger 700 is in operation, the second fan component 720 operates and indoor air flows from the heat exchanger inlet 806 into the first mounting cavity to exchange heat with the heat exchanger component 730 and then flows from the heat exchanger outlet 807 on both sides to the indoor, thereby adjusting the indoor temperature.

The air treatment apparatus 200 may operate as following cases: only the air inlet 201 of the three air inlets 201 connected to the outdoor air is exposed; only the air inlet 201 of the three air inlets 201 connected to the indoor air is exposed; and all three air inlets 201 are exposed.

Case 1: only the air inlet 201 connected to the outdoor air in the three air inlets 201 is exposed, and the air treatment apparatus 200 operation may include the following cases.

When only the air treatment apparatus 200 is in operation, the first fan component 21 operates. When only air is needed from the first vent 808, the air guide plate 810 covers the second vent 809 and the air guide mechanism 20 exposes the first air outlet 101. At this time, the first air outlet 101 is in communication with the first vent 808 through the air induction cavity 701. After being purified by the purification component 23, air introduced from outdoor flows upward into the air outlet cavity 103 of the air outlet casing 10, without being humidified by the humidification component 22, and then flows into the air induction cavity 701 through the first air outlet 101, and finally flows out from the first vent 808 to the indoor. Thus, the outdoor air can be introduced into the indoor, and at this time, the outdoor air introduced from the at least one air inlet 201 can be purified and then flow into the indoor to improve the indoor air quality.

When only air is needed from the second vent 809, the air guide plate 810 exposes the second vent 809 and the air guide mechanism 20 covers the first air outlet 101. After being purified by the purification component 23, air introduced from outdoor flows upward into the air outlet cavity 103 of the air outlet casing 10, with being humidified by the humidification component 22, and then flows into the indoor through the two second air outlets 102 and two second vents 809 in sequence. The air introduced from outdoor no longer flows out from the first vent 808, but flows into the indoor through the second vents 809 from the second air outlets 102 on both sides. Therefore, the outdoor air can be introduced into the indoor, and at this time, the outdoor air introduced from the at least one air inlet 201 can be purified and humidified, and then flows into the indoor to improve the indoor air quality.

When the air is needed from the first vent 808 and the second vent 809 at the same time, the guide air device 20 exposes the first air outlet 101 and the guide air plate 810 exposes the second vent 809. After the first fan component 21 driving air from the at least one air inlet 201 into the first fan component 21, the air flows upward to be purified by the purification component 23, and then flows upward into the air outlet cavity 103. For the air flowing into the air chamber 103, a part of the air does not flow through the humidification component 22 to be humidified but flow upward through the first air outlet 101 to the air induction cavity 701 and flow into the indoor through the first vent 808; the other part of the air is humidified by the humidification component 22 and flows out from the two second air outlets 102 and the second vent 809 in sequence. In addition, fresh air introduced from the outdoor simultaneously flows out from the first vent 808 and the second vent 809, which increases a range of air flow and provides a multi-dimensional air flow. At this time, the outdoor air introduced from the at least one air inlet 201 can be purified, partially humidified, and then flowed into the indoor, which can quickly and effectively improve the indoor air quality.

In one embodiment, the first air outlet 201 may be in a normally open state while the air treatment apparatus 200 is in operation. For example, the first air outlet 201 is exposed when the first fan component 21 is powered on and operating, and the first air outlet 201 is covered accordingly when the first fan component 21 is covered. Whether to open the second vent 809 can be judged according to whether there is a humidification demand, the second vent 809 can be exposed when there is the humidification demand, and the second vent 809 can be covered when there is no humidification demand.

Case 2: only the air inlet 201 connected to the indoor air is exposed in the three air inlets 210, and the air treatment apparatus 200 operation may include the following cases.

When only the air treatment apparatus 200 is in operation, the first fan component 21 operates. When only air is needed from the first vent 808, the air guide plate 810 covers the second vent 809 and the air guide mechanism 20 exposes the first air outlet 101. At this time, the first air outlet 101 is in communication with the first vent 808 through the air induction cavity 701. After being purified by the purification component 23, the air introduced from indoor flows upward into the air outlet cavity 103 of the air outlet casing 10, without being humidified by the humidification component 22, and then flows into the air induction cavity 701 through the first air outlet 101, and finally flows out from the first vent 808 to the indoor. Thus, the indoor air can be purified and the indoor air quality can be improved.

When only air is needed from the second vent 809, the air guide plate 810 exposes the second vent 809 and the air guide mechanism 20 covers the first air outlet 101. After being purified by the purification component 23, air introduced from indoor flows upward into the air outlet cavity 103 of the air outlet casing 10, with being humidified by the humidification component 22, and then flows into the indoor through the two second air outlets 102 and two second vents 809 in sequence. The air introduced from indoor no longer flows out from the first vent 808, but flows into the indoor through the second vents 809 from the second air outlets 102 on both sides. Therefore, the indoor air can be purified and humidified to improve indoor air quality.

When the air is needed from the first vent 808 and the second vent 809 at the same time, the guide air device 20 exposes the first air outlet 101 and the guide air plate 810 exposes the second vent 809. After the first fan component 21 driving air from the at least one air inlet 201 into the first fan component 21, the air flows upward to be purified by the purification component 23, and then flows upward into the air outlet cavity 103. For the air flowing into the air chamber 103, a part of the air does not flow through the humidification component 22 to be humidified but flow upward through the first air outlet 101 to the air induction cavity 701 and flow into the indoor through the first vent 808; the other part of the air is humidified by the humidification component 22 and flows out from the two second air outlets 102 and the second vent 809 in sequence. In addition, the air introduced from the indoor simultaneously flows out from the first vent 808 and the second vent 809, which increases the range of air flow and provides the multi-dimensional air flow. At this time, the indoor air introduced from the at least one air inlet 201 can be purified, partially humidified, and then flowed into the indoor, which can quickly and effectively improve the indoor air quality.

In one embodiment, the first air outlet 201 may be in the normally open state while the air treatment apparatus 200 is in operation. For example, the first air outlet 201 is exposed when the first fan component 21 is powered on and operating, and the first air outlet 201 is covered accordingly when the first fan component 21 is closed. According to whether there is a humidification demand to determine whether to open the second vent 809, when there is the humidification demand can open the second vent 809, and when there is no humidification demand can cover the second vent 809.

Case 3: all three air inlets 210 are exposed, and the air treatment apparatus 200 operation may include the following cases.

When only air treatment apparatus 200 is in operation, the first fan component 21 operates. When only air is needed from the first vent 808, the air guide plate 810 covers the second vent 809 and the air guide mechanism 20 exposes the first air outlet 101. At this time, the first air outlet 101 is in communication with the first vent 808 through the air induction cavity 701. After being purified by the purification component 23, the air introduced from indoor and the air introduced from outdoor flow upward into the air outlet cavity 103 of the air outlet casing 10, without being humidified by the humidification component 22, and then flow into the air induction cavity 701 through the first air outlet 101, and finally flow out from the first vent 808 to the indoor. Thus, the indoor air can be purified and the indoor air quality can be improved. In addition, the fresh air can be introduced and the introduced fresh air can be purified.

When only air is needed from the second vent 809, the air guide plate 810 exposes the second vent 809 and the air guide mechanism 20 covers the first air outlet 101. After being purified by the purification component 23, air introduced from outdoor flows upward into the air outlet cavity 103 of the air outlet casing 10, with being humidified by the humidification component 22, and then flows into the indoor through the two second air outlets 102 and two second vents 809 in sequence. The air introduced from outdoor no longer flows out from the first vent 808, but flows into the indoor through the second vents 809 from the second air outlets 102 on both sides. Therefore, the indoor air can be purified and humidified to improve indoor air quality. In addition, the fresh air can be introduced, and the introduced fresh air can be purified and humidified.

When the air is needed from the first vent 808 and the second vent 809 at the same time, the guide air device 20 exposes the first air outlet 101 and the guide air plate 810 exposes the second vent 809. After the first fan component 21 driving air from the at least one air inlet 201 into the first fan component 21, the air flows upward to be purified by the purification component 23, and then flows upward into the air outlet cavity 103. For the air flowing into the air chamber 103, a part of the air does not flow through the humidification component 22 to be humidified but flow upward through the first air outlet 101 to the air induction cavity 701 and flow into the indoor through the first vent 808; the other part of the air is humidified by the humidification component 22 and flows out from the two second air outlets 102 and the second vent 809 in sequence. In addition, the air introduced from the indoor and the air introduced from the outdoor simultaneously flow out from the first vent 808 and the second vent 809, which increases the range of air flow and provides the multi-dimensional air flow. At this time, the air introduced from the at least one air inlet 201 can be purified, partially humidified, and then flowed into the indoor, which can quickly and effectively improve the indoor air quality. In addition, the fresh air can be introduced, and the introduced fresh air can be purified and partially humidified.

In one embodiment, the first air outlet 201 may be in the normally open state while the air treatment apparatus 200 is in operation. For example, the first air outlet 201 is exposed when the first fan component 21 is powered on and operating, and the first air outlet 201 is covered accordingly when the first fan component 21 is covered. According to whether there is a humidification demand to determine whether to open the second vent 809, when there is the humidification demand can open the second vent 809, and when there is no humidification demand can cover the second vent 809.

In one embodiment, the first air outlet 201 may be in the normally open state while the air treatment apparatus 700 is in operation. For example, the first air outlet 201 is exposed when the first fan component 21 is powered on and operating, and the first air outlet 201 is covered accordingly when the first fan component 21 is covered. According to whether there is a humidification demand to determine whether to open the second vent 809, when there is the humidification demand can open the second vent 809, and when there is no humidification demand can cover the second vent 809.

When both the air treatment apparatus 200 and the air heat exchanger apparatus 700 are in operation, the room temperature can be regulated while the indoor air quality can be improved. For the operational status of the air treatment apparatus 200, reference can be made to the above description.

In the description of the present disclosure, reference throughout this specification to "an embodiment," "some embodiments," "an example," "an exemplary example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the features, structures, materials, or characteristics may be combined in any suitable manner in one or more embodiments or examples. Without a contradiction, the different embodiments or examples and the features of the different embodiments or examples can be combined by those skilled in the art.

Although embodiments of the present disclosure have been illustrated and described, it is conceivable for those of ordinary skill in the art that various changes, modifications, replacements, and variations can be made to these embodiments without departing from the principles and spirit of the present disclosure. The scope of the present disclosure shall be formed by the claims as appended and their equivalents.

What is claimed is:

1. An air conditioner comprising:

a housing having an air outlet chamber, a vent connecting the air outlet chamber with an outside being formed at a sidewall of the air outlet chamber;

an air treatment apparatus disposed in the housing, the air treatment apparatus including an air treatment unit and having an air inlet; and an air guide mechanism movably disposed in the housing and configured to connect an inner cavity of the air treatment unit with the outside or isolate the inner cavity of the air treatment unit from the outside, wherein when the inner cavity of the air treatment unit is in communication with the outside, air entering through the air inlet flows through the air treatment unit and into the air outlet chamber, and then flows out through the vent;

wherein the housing includes:

a rear casing component; and a front panel connected to a front side of the rear casing component, the front panel including an upper panel and a lower panel that are spaced apart from top to bottom, and the vent being formed between the upper panel and the lower panel.

2. The air conditioner according to claim 1, wherein in a height direction of the housing, the air outlet chamber is disposed at a middle of the housing or is adjacent to the middle of the housing.

3. The air conditioner according to claim 1, wherein the housing further includes an air outlet frame component disposed on the front side of the rear casing component, the front panel being disposed on a front side of the air outlet frame component, a part of the air outlet frame component corresponding to the air treatment unit being opened to form a removal opening, and the lower panel being configured to cover or expose the removal opening.

4. The air conditioner according to claim 1, wherein the air guide mechanism is movably disposed in the air treatment apparatus.

5. The air conditioner according to claim 4, wherein the air treatment apparatus includes an air outlet casing disposed in the air treatment unit, the air outlet casing forming an air outlet cavity in communication with the inner cavity of the air treatment unit, the air outlet casing having an air outlet in communication with the air outlet cavity, the air guide mechanism being movably disposed in the air outlet casing and configured to cover or expose the air outlet, and the vent being in communication with the air outlet through the air outlet chamber when the air guide mechanism exposes the air outlet.

6. The air conditioner according to claim 5, wherein the air outlet casing is disposed below the air outlet chamber, the air outlet being formed at a top of the air outlet casing, and the air guide mechanism being disposed in the air outlet casing in an up-down movable manner.

7. The air conditioner according to claim 6, wherein at least a part of the air guide mechanism is disposed in the air outlet chamber when the air guide mechanism exposes the air outlet.

8. The air conditioner according to claim 6, wherein the air treatment apparatus includes an air induction hood disposed on a top of the air outlet casing and in the air outlet chamber, an air induction cavity being formed between the top of the air outlet casing and the air induction hood, at least a part of an air induction outlet of the air induction cavity corresponding to and being in communication with the vent, and the vent being in communication with the air outlet through the air induction cavity when the air guide mechanism exposes the air outlet.

9. The air conditioner according to claim 8, wherein at least a part of the air guide mechanism is disposed in the air induction cavity when the air guide mechanism exposes the air outlet.

10. The air conditioner according to claim 6, wherein the air outlet casing comprises a casing body and an air outlet component, a mounting opening being formed at a top of the casing body, the air outlet component being disposed at the mounting opening, the air outlet being formed at the air outlet component, the air guide mechanism including an air guide component and a mounting base, the air guide component being configured to cover or expose the air outlet, the mounting base being connected to a lower part of the air guide component, and the mounting base passing through the air outlet component in an up-down movable manner.

11. The air conditioner according to claim 10, wherein the air outlet component includes:

an air outlet member disposed in the mounting opening, the air outlet being formed at the air outlet member; and a mounting member connected to a lower part of the air outlet member and disposed within the air outlet cavity, wherein a receiving cavity having an open top is formed in the mounting member, the mounting base being disposed in the receiving cavity in an up-down movable manner.

12. The air conditioner according to claim 11, wherein the air outlet member includes an air outlet grille disposed at the air outlet and comprises at least one air outlet sub-grille obliquely arranged, the at least one air outlet sub-grille obliquely arranged extending upwardly and obliquely in a direction from a connection between the air outlet member and the mounting member to an outer edge of the air outlet member.

13. The air conditioner according to claim 11, wherein the air outlet member includes an air outlet grille disposed at the air outlet, air dispersion holes of the air outlet grille having an equivalent diameter of 3 mm to 8 mm.

14. The air conditioner according to claim 6, wherein:

the vent is a first vent and the air outlet is a first air outlet;

a second air outlet is formed at a circumferential side wall of the air outlet casing; and wherein the housing has a second vent corresponding to and in communication with the second air outlet.

15. The air conditioner according to claim 14, wherein an air guide plate is disposed at the second vent and configured to cover or expose the second vent.

16. The air conditioner according to claim 5, wherein the air treatment unit includes:

a fan component configured to drive air into the air treatment apparatus through the air inlet;

a humidification component disposed in the air outlet casing, the air outlet cavity being formed between the humidification component and the air outlet casing; and a purification component disposed between the air outlet casing and the first fan component, the purification component having a purification cavity in communication with the air outlet cavity.

17. The air conditioner according to claim 16, wherein the fan component, the purification component and the air outlet casing are sequentially arranged from bottom to top.

18. The air conditioner according to claim 16, wherein the humidification component includes:

a humidification bracket having a humidification sink, the humidification bracket being disposed in the air outlet casing in a drawable manner;

a wet film bracket disposed on the humidification bracket;

a humidification film disposed in the wet film bracket, a part of the humidification film being disposed in the humidification sink; and a humidification water tank disposed in the humidification bracket, the humidification water tank being disposed on a side of the wet film bracket facing away from the air outlet cavity, and the humidification water tank being configured to supply water to the humidification sink.

19. The air conditioner according to claim 18, wherein the vent is a first vent and the air outlet is a first air outlet formed at a top of the air outlet casing;

the air outlet casing is disposed below the air outlet chamber;

the air guide mechanism is disposed in the air outlet casing in an up-down movable manner;

a second air outlet is formed at a circumferential side wall of the air outlet casing;

a second vent corresponding to and in communication with the second air outlet is formed at the housing; and the humidification film is close to the second air outlet and corresponds to the second air outlet.

20. An air conditioner comprising:

a housing having an air outlet chamber, a vent connecting the air outlet chamber with an outside being formed at a sidewall of the air outlet chamber;

an air treatment apparatus disposed in the housing, the air treatment apparatus including an air treatment unit and having an air inlet; and an air guide mechanism movably disposed in the housing and configured to connect an inner cavity of the air treatment unit with the outside or isolate the inner cavity of the air treatment unit from the outside, wherein when the inner cavity of the air treatment unit is in communication with the outside, air entering through the air inlet flows through the air treatment unit and into the air outlet chamber, and then flows out through the vent;

wherein the air guide mechanism is movably disposed in the air treatment apparatus, and the air treatment apparatus includes an air outlet casing disposed in the air treatment unit, the air outlet casing forming an air outlet cavity in communication with the inner cavity of the air treatment unit, the air outlet casing having an air outlet in communication with the air outlet cavity, the air guide mechanism being movably disposed in the air outlet casing and configured to cover or expose the air outlet, and the vent being in communication with the air outlet through the air outlet chamber when the air guide mechanism exposes the air outlet.

* * * * *